US010414997B2

(12) United States Patent
Chung et al.

(10) Patent No.: US 10,414,997 B2
(45) Date of Patent: Sep. 17, 2019

(54) LUBRICANT ADDITIVES, LUBRICANT COMPOSITIONS, AND APPLICATIONS OF SAME

(71) Applicant: Northwestern University, Evanston, IL (US)

(72) Inventors: Yip-Wah Chung, Wilmette, IL (US); Qian Wang, Mount Prospect, IL (US); Blake A. Johnson, Evanston, IL (US)

(73) Assignee: NORTHWESTERN UNIVERSITY, Evanston, IL (US)

( * ) Notice: Subject to any disclaimer, the term of this patent is extended or adjusted under 35 U.S.C. 154(b) by 0 days.

(21) Appl. No.: 15/521,337

(22) PCT Filed: Oct. 22, 2015

(86) PCT No.: PCT/US2015/056965

§ 371 (c)(1),
(2) Date: Apr. 24, 2017

(87) PCT Pub. No.: WO2016/065175

PCT Pub. Date: Apr. 28, 2016

(65) Prior Publication Data

US 2017/0306258 A1 Oct. 26, 2017

Related U.S. Application Data

(60) Provisional application No. 62/067,719, filed on Oct. 23, 2014.

(51) Int. Cl.
*C10M 129/06* (2006.01)
*C10M 129/28* (2006.01)
(Continued)

(52) U.S. Cl.
CPC ..... *C10M 129/28* (2013.01); *C10M 129/06* (2013.01); *C10M 133/06* (2013.01);
(Continued)

(58) Field of Classification Search
CPC ..... C10M 129/06; C10M 129/46; C10M 161/00; C10M 129/28; C10M 129/32;
(Continued)

(56) References Cited

U.S. PATENT DOCUMENTS 2,545,138 A * 3/1951 Werner ..... C10M 1/08 106/14.23
2,576,032 A * 11/1951 Mowray et al. ..... C10M 5/00 508/535
(Continued)

FOREIGN PATENT DOCUMENTS

JP H07176044 A 7/1995
JP 2010-065198 A 3/2010
(Continued)

OTHER PUBLICATIONS

K. Holmberg, P. Andersson, and A. Erdemir, Global energy consumption due to friction in passenger cars, Tribology International 47 (2012) 221-234.
(Continued)

*Primary Examiner* — James C Goloboy
(74) *Attorney, Agent, or Firm* — Tim Tingkang Xia, Esq.; Locke Lord LLP

(57) ABSTRACT

A lubricant composition includes a base lubricant and a plurality of lubricant additive molecules. Each lubricant additive molecule includes a surface active group attractable to a target surface, and a carbon containing component connected to the surface active group, for providing a carbon source to form a carbon film on the target surface. A method for in situ forming of a carbon film using the lubricant composition, includes adding the lubricant composition into a target machine such that the lubricant composition is in contact with a target surface of the target machine, and operating the target machine to cause a temperature and a pressure at the target surface so that the carbon containing
(Continued)

component is unraveled thereon to form a carbon film on the target surface during the operation.

10 Claims, 22 Drawing Sheets

(51) Int. Cl.
*C10M 133/06* (2006.01)
*C10M 139/04* (2006.01)

(52) U.S. Cl.
CPC .. *C10M 139/04* (2013.01); *C10M 2205/0285* (2013.01); *C10M 2207/021* (2013.01); *C10M 2207/12* (2013.01); *C10M 2215/04* (2013.01); *C10M 2227/04* (2013.01); *C10N 2230/06* (2013.01); *C10N 2250/18* (2013.01); *C10N 2280/00* (2013.01)

(58) Field of Classification Search
CPC ..... C10M 133/06; C10M 139/04; C10M 2205/0285; C10M 2207/021; C10M 2227/04; C10N 2230/06; C10N 2250/18; C10N 2280/00
See application file for complete search history.

(56) References Cited

U.S. PATENT DOCUMENTS

| | | | | |
|---|---|---|---|---|
| 5,244,591 | A * | 9/1993 | Middleton | C10M 163/00 252/395 |
| 5,558,805 | A * | 9/1996 | Colclough | C10M 135/00 508/243 |
| 5,817,605 | A * | 10/1998 | Papay | C10M 141/02 508/185 |
| 7,635,669 | B2 * | 12/2009 | Culley | C10L 1/1881 252/76 |
| 2006/0189489 | A1 * | 8/2006 | Fujitsu | C10M 141/06 508/447 |
| 2009/0239773 | A1 | 9/2009 | Haramoto | |

FOREIGN PATENT DOCUMENTS

| | | | |
|---|---|---|---|
| WO | 2005111264 | A1 | 11/2005 |
| WO | 2012115142 | A1 | 8/2012 |

OTHER PUBLICATIONS

Dake, "A Review of DOE ECUT Tribology Surveys," J. Tribol., vol. 108, No. (4), pp. 497-501, 1986.
R. Savage, "Graphite Lubrication," Journal of Applied Physics, vol. 19, No. 1, pp. 1-10, 1948.
H. Y. Hisakado, "Lubrication mechanism of solid lubricants in oils," Journal of Lubrication Technology, vol. 105, p. 245, 1983.
A. Kovalchenko, "Friction and Wear Performance of Low-Friction Carbon Coatings Under Oil Lubrication," Energy Technology Div., Argonne National Laboratory, Argonne, IL, 2001.
A. Grill, "Diamond-like carbon: state of the art," Diamond and related materials, vol. 8, No. 2, pp. 428-434, 1999.
De Barros' Bouchet, "Boundary lubrication mechanisms of carbon coatings by MoDTC and ZDDP additives," Tribology International, vol. 38, No. 3, pp. 257-264, 2005.
Morina, "Understanding the composition and low friction tribofilm formation/removal in boundary lubrication," Tribology International, vol. 40, No. 10, pp. 1696-1704, 2007.
Singer, "Role of Third Bodies in Friction Behavior of Diamond-like Nanocomposite Coatings Studied by In Situ Tribometry," Tribology Transactions, vol. 45, No. 3, pp. 363-371, 2002.
Erdemir, "Tribochemically driven diamond-like carbon boundary films from base lubricating oils," in STLE Annual Meeting, Detroit, 2013.
ASTM, "Standard test method for wear testing with a pin-on-disk apparatus," in ASTM Book of Standards, 2010, pp. G99-G05.
Chevron Phillips, "Synfluid PAO 4 cSt," Chevron Phillips, The Woodlands, TX, 2011.
H. Halidou, "Novel carbon nanostructures of caterpillar-like fibers and interwoven spheres with excellent surface superhydrophobicity produced by chemical vapor deposition," Journal of Materials Chemistry, vol. 18, No. 11, pp. 1245-1252, 2008.
Korean Intellectual Property Office (ISR/KR), "International Search Report for PCT/US2015/056965", Korea, Jan. 28, 2016.

* cited by examiner

PAO4

PAO4+2.5wt% CPCa

LUBRICANT ADDITIVES, LUBRICANT COMPOSITIONS, AND APPLICATIONS OF SAME

CROSS-REFERENCE TO RELATED PATENT APPLICATION

This application claims priority to and the benefit of, pursuant to 35 U.S.C. § 119(e), U.S. provisional patent application Ser. No. 62/067,719, filed Oct. 23, 2014, entitled "LUBRICANT ADDITIVES, LUBRICANT COMPOSITIONS, AND APPLICATIONS OF SAME," by Qian Jane Wang, Yip-Wah Chung and Blake A. Johnson, which is incorporated herein in its entirety by reference.

Some references, which may include patents, patent applications and various publications, are cited and discussed in the description of this invention. The citation and/or discussion of such references is provided merely to clarify the description of the present invention and is not an admission that any such reference is "prior art" to the invention described herein. All references cited and discussed in this specification are incorporated herein by reference in their entireties and to the same extent as if each reference was individually incorporated by reference. In terms of notation, hereinafter, "[n]" represents the nth reference cited in the reference list. For example, [1] represents the 1st reference cited in the reference list, namely, K. Holmberg, P. Andersson, and A. Erdemir, Global energy consumption due to friction in passenger cars, Tribology International 47 (2012) 221-234.

FIELD OF THE INVENTION

The invention relates generally to a lubricant composition, and more particularly to a lubricant composition having a lubricant additive used for tribologically-activated in situ deposition of a carbon film.

BACKGROUND OF THE INVENTION

The background description provided herein is for the purpose of generally presenting the context of the present invention. The subject matter discussed in the background of the invention section should not be assumed to be prior art merely as a result of its mention in the background of the invention section. Similarly, a problem mentioned in the background of the invention section or associated with the subject matter of the background of the invention section should not be assumed to have been previously recognized in the prior art. The subject matter in the background of the invention section merely represents different approaches, which in and of themselves may also be inventions. Work of the presently named inventors, to the extent it is described in the background of the invention section, as well as aspects of the description that may not otherwise qualify as prior art at the time of filing, are neither expressly nor impliedly admitted as prior art against the present invention.

The efficiency and reliability of automobiles and heavy machinery are ever-present concerns for the economic, industrial, and environmental status and growth of the world. In vehicle engine systems, at least one third of the energy from fuel goes into overcoming frictional losses [1]. A study by the U.S. Department of Energy concluded that $120 billion could be saved annually by reducing friction and wear in engine and drivetrain components, and tribological improvements could also save the utilities industry $2.5 billion annually. These savings can come from both reduced friction, as well as a reduction in repair costs from wear damage. The study suggests that these savings can most likely be achieved through enhanced tribological surface coatings and lubricant additives [2].

Engine, electric generators, and all types of machinery components are very commonly lubricated with an oil-based lubricant. These oils are viscosity-controlled fluids that contain a wide range of additives. Those lubricant additives are commonly used to soften the contact between two solids, optimize the viscosity of lubricants, and generate protective layers on top of contact surfaces. The lubricant additives used to reduce friction and wear include, for example, zinc dialkyldithiophosphates (ZDDP), molybdenum disulfide ($MoS_2$), and carbon coating. However, it is still a challenge to form a lubricant composition that is environment friendly, highly efficient, long-lasting, wear preventing, and can be applied in situ.

Therefore, a heretofore unaddressed need exists in the art to address the aforementioned deficiencies and inadequacies.

SUMMARY OF THE INVENTION

In one aspect, the invention is related to a lubricant additive. The lubricant additive includes a surface active group attractable to a target surface, and a carbon containing component connected to the surface active group, for providing a carbon source to form a carbon film on the target surface.

In one embodiment, the carbon film is formed only when tribological energy activates the lubricant additive to unravel the carbon containing component. Flash heating from asperity contacts heats the lubricant additive to above a threshold temperature, which causes decomposition of the carbon containing component, releases lubricious carbon onto the target surface, thereby forming the carbon film on the target surface. Carbon is not formed in the bulk fluid before the lubricant additive is used as a lubricant.

In certain embodiments, the lubricant additive binds to the target surface via polar (electrostatic) or chemical interactions through the surface active group.

In certain embodiments, the surface active group has positive charges, and the target surface has negative charges, and vice versa, such that the surface active group is attractable to the target surface.

In certain embodiments, the surface active group includes a carboxyl group, a hydroxyl group, a siloxyl group, an amine group, or a mixture thereof.

In certain embodiments, the carbon containing component comprises a carbon ring, a straight carbon chain, a branched carbon chain, or a mixture thereof.

In one embodiment, the carbon ring includes three or more carbon atoms arranged in a strained, metastable ring, such as cyclopropane or cyclobutane.

In certain embodiments, the lubricant additive further includes a spacer group connecting the carbon ring to the surface active group. In one embodiment, the spacer group is a carbon chain having 1-20, or more, carbon atoms. In one embodiment, the length of the spacer is configured to form the carbon film under a temperature and a pressure at the target surface.

In certain embodiments, the lubricant additive includes cyclopropanecarboxylic acid, cyclobutanecarboxylic acid, cyclopropylacetic acid, cyclopropanol, cyclobutanol, or a mixture thereof.

In certain embodiments, the carbon film on the target surface is formed by releasing the carbon source from the carbon containing component under a pressure and a temperature at the target surface. In one embodiment, the pressure and the temperature at the target surface is resulted by running a target machine having the target surface. In certain embodiments, the temperature at the target surface is in a range of from about room temperature to about 500° C. The room temperature may be 20° C. or 25° C. In one embodiment, the temperature at the target surface is in a range of 60° C.-300° C. In one embodiment, the temperature at the target surface is in a range of 90° C.-115° C. In one embodiment, the temperature at the target surface is higher than 90° C. due to the heat generated by friction. In one embodiment, the nominal Hertzian pressure at the target surface is in a range of 0.4 to 2.0 GPa.

In certain embodiments, the carbon film includes a plurality of graphitic sheets, amorphous and diamond-like carbon, or a mixture thereof. In one embodiment, percentages of the graphitic sheet and the amorphous and diamond-like carbon in the carbon film depends on a temperature and a pressure at the target surface. In one embodiment, the carbon film comprises substantially the graphitic sheet.

In another aspect, the present invention relates to a lubricant composition. In one embodiment, the lubricant composition includes a plurality of lubricant additive molecules. Each of the lubricant additive molecules has a surface active group attractable to a target surface, and a carbon containing component connected to the surface active group, for providing a carbon source to form a carbon film on the target surface. The target surface can be a surface of an engine or other machinery.

In one embodiment, the lubricant composition further include a base lubricant. That is, the lubricant additive molecules are added to a base lubricant, such as an oil-based lubricant, to form the lubricant composition.

In certain embodiments, the lubricant composition has about 1-10 weight percentage (wt %) of the lubricant additive molecules. In one embodiment, the lubricant composition comprises about 2.5 wt % of the lubricant additive molecules.

In certain embodiments, the lubricant additive binds to the target surface via polar (electrostatic) or chemical interactions through the surface active group.

In certain embodiments, the surface active group has positive charges, and the target surface has negative charges, and vice versa, such that the surface active group is attractable to the target surface. In other embodiments, the surface active group can have other properties that can be used to be attached to the target surface.

In one embodiment, the surface active group includes a carboxyl group, a hydroxyl group, a siloxyl group, an amine group or a mixture thereof.

In certain embodiments, the carbon containing component comprises a carbon ring, a straight carbon chain, a branched carbon chain, or a mixture thereof.

In one embodiment, the carbon ring includes three or more carbon atoms arranged in a strained, metastable ring, such as cyclopropane or cyclobutane.

In certain embodiments, the lubricant additive further includes a spacer group connecting the carbon ring to the surface active group. In one embodiment, the spacer group is a carbon chain having 1-20, or more, carbon atoms. In one embodiment, the length of the spacer is configured to form the carbon film under a temperature and a pressure at the target surface.

In certain embodiments, the lubricant additive includes cyclopropanecarboxylic acid, cyclobutanecarboxylic acid, cyclopropylacetic acid, cyclopropanol, cyclobutanol, or a mixture thereof.

In certain embodiments, the carbon film on the target surface is formed by releasing the carbon source from the carbon containing component under a pressure and a temperature at the target surface. In one embodiment, the pressure and the temperature at the target surface is resulted by running a target machine having the target surface. In certain embodiments, the temperature at the target surface is in a range of from about room temperature to about 500° C. The room temperature may be 20° C. or 25° C. In one embodiment, the temperature at the target surface is in a range of 60° C.-300° C. In one embodiment, the temperature at the target surface is in a range of 90° C.-115° C. In one embodiment, the temperature at the target surface is higher than 90° C. due to the heat generated by friction. In one embodiment, the nominal Hertzian pressure at the target surface is in a range of 0.4 to 2.0 GPa.

In certain embodiments, the carbon film includes a plurality of graphitic sheets, amorphous and diamond-like carbon, or a mixture thereof. In one embodiment, percentages of the graphitic sheet and the amorphous and diamond-like carbon in the carbon film depends on a temperature and a pressure at the target surface. In one embodiment, the carbon film comprises substantially the graphitic sheet.

In yet another aspect, the present invention relates to a method for in situ forming of a carbon film on a target surface of a target machine. The method includes: adding a lubricant composition into the target machine, wherein the lubricant composition is in contact with the target surface of the target machine, and comprises a plurality of lubricant additive molecules, and each lubricant additive molecule comprising a surface active group and a carbon containing component connected to the surface active group, and operating the target machine to cause a temperature and a pressure at the target surface so that the carbon containing component is unraveled thereon to form a carbon film on the target surface during the operation. In curtain embodiments, the carbon containing component comprises a carbon ring, a straight carbon chain, a branched carbon chain, or a mixture thereof.

Depending on the lubricant additive used, specifically the length of the spacer and groups attached to some of the carbon atoms in the carbon ring, the temperature and pressure at the target surface, and the duration of the operation time of the target machine, the formed carbon film can be a plurality of graphitic sheets, amorphous and diamond-like carbon, or a mixture thereof. In one embodiment, the carbon film is substantially one or more graphitic sheets.

In certain embodiments, the carbon film is formed in less than seconds to one hour.

In certain embodiments, the lubricant additive is mixed with the base lubricant to form the lubricant composition before use. In other embodiments, the lubricant additive is added directly to the target machine where base lubricant has already been added.

These and other aspects of the invention will become apparent from the following description of the preferred embodiment taken in conjunction with the following drawings, although variations and modifications therein may be affected without departing from the spirit and scope of the novel concepts of the invention.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment.

FIG. 8A shows a plot of coefficient of friction of the samples, and FIG. 8B shows a plot of wear rate of the samples.

FIG. 10A shows a plot of coefficient of friction versus normal loads, and FIG. 10B shows a plot of coefficient of friction versus relative motion.

FIG. 11A shows a plot of log wear volume versus normal loads, FIG. 11B shows a plot of log wear volume versus relative motion, FIG. 11C shows a white light interferometry map of the sample surface treated with the lubricant (no additive), and FIG. 11D shows a white light interferometry map of the sample surface treated with the lubricant having the lubricant additive.

FIG. 12A shows a plot of coefficient of Friction at stage 1, stage 2, and the average, FIG. 12B shows a plot of wear volume of the two disks at stage 2.

FIG. 13A shows the color of the 5w30 engine oil with and without adding the lubricant additive, FIG. 13B shows a plot of coefficient of friction in boundary lubrication and hydrodynamic lubrication regimes, and FIG. 11C shows a plot of log wear volume of different sample surfaces.

FIG. 14A shows Raman spectra of different sample surfaces, and FIG. 14B shows white light interferometry map of different sample surfaces.

DETAILED DESCRIPTION OF THE INVENTION

Figure 1C:
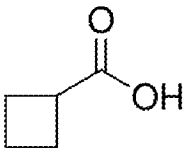
FIGS. 1B-1F show schematically lubricant additive molecules according to certain embodiments of the invention.

The invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

It will be understood that, as used in the description herein and throughout the claims that follow, the meaning of "a", "an", and "the" includes plural reference unless the context clearly dictates otherwise. Also, it will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

It will be further understood that the terms "comprises" and/or "comprising," or "includes" and/or "including" or "has" and/or "having" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising," "including," "carrying," "having," "containing," "involving," and the like are to be understood to be open-ended, i.e., to mean including but not limited to.

The description will be made as to the embodiments of the invention in conjunction with the accompanying drawings. In accordance with the purposes of this disclosure, as embodied and broadly described herein, this disclosure, in one aspect, relates to a lubricant composition having a lubricant additive used for tribologically-activated in situ deposition of a carbon film.

Specifically, the lubricant composition utilizes carbon lubrication as an additive to reduce friction and wear in the boundary lubrication regime of sliding contact. Carbon layers can mitigate friction and wear by using this sliding motion to absorb the stress of asperity contact [3,4].

Graphite is stable at high temperatures, and is commonly used for high load, low speed boundary lubrication conditions. Several commercial engine lubrication products use graphite suspended in oil as an anti-wear, anti-friction additive. These products are especially popular as a "breaking-in" engine oil, where a large amount of asperity contact is expected. Current carbon lubrication products have several limitations. First, graphite suspended in oil or applied directly to a contact must frequently be replenished. "Squeeze-out" occurs where the asperity contact dislocates the carbon away from the contact point. Issues with agglomeration of the carbon also limit the lifetime of these products. Currently, carbon coatings are applied prior to the service of a part, and once they wear away, there is no way to reapply them without disassembly of a machine.

In one aspect, the invention relates to a carbon lubrication using diamond-like carbon (DLC). DLC is a layer of $sp^2$ and $sp^3$ bonded carbon atoms over contact surfaces and show remarkable performance in friction reduction and wear protection [5, 6]. DLC exhibits the traits of graphitic carbon, diamond, and polymeric carbon, which combine for a flexible, hard, inert, and friction reducing coating [7]. In vehicles, DLC has the potential for replacing molybdenum disulfide anti-friction films, which are currently used for the same purpose. These sulfur-containing films may damage catalytic converters and are therefore environmentally detrimental [8, 9]. However, application of DLC normally requires a vacuum-based process and is expensive. Once worn, it cannot be replenished by such a process unless the machinery is disassembled, which is not practical. DLC's wear resistance is attributed to the hardness of the $sp^3$ carbon bonds. It was recently discovered that DLC films show low friction results through the creation of a carbon "transfer film." This transfer film is made up of graphite-like carbon sourced from the DLC surface, which behaves similarly to graphitic lubricant additives for friction reduction [10].

In one aspect, the invention relates to generating carbon-enhanced surfaces through surface catalysis, using frictional heat and contact pressure already present during operation of engines and machinery [11].

In one aspect, the invention is related to a lubricant additive. The lubricant additive includes a surface active group attractable to a target surface, and a carbon containing component connected to the surface active group, for providing a carbon source to form a carbon film on the target surface. In certain embodiments, the surface active group includes a carboxyl group, a hydroxyl group, a siloxyl group, an amine group, or a mixture thereof. In certain embodiments, the carbon containing component comprises a carbon ring, a straight carbon chain, a branched carbon chain, or a mixture thereof. In certain embodiments, the carbon film is formed only when tribological energy activates the lubricant additive to unravel the carbon containing component. Flash heating from asperity contacts heats the lubricant additive to above a threshold temperature, which causes decomposition of the carbon containing component, releases lubricious carbon onto the target surface, thereby forming the carbon film on the target surface. Carbon is not formed in the bulk fluid before the lubricant additive is used as a lubricant.

Figure 1E:
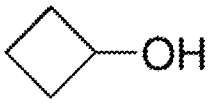
Figure 1B:
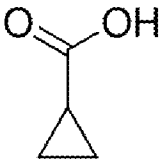
Figure 1D:
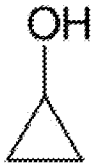

FIG. 1B-FIG. 1F show schematically novel anti-wear, anti-friction, carbon-based lubricant additive molecules according to certain embodiments of the invention. Referring to FIG. 1A, a carbon-based lubricant additive 100 includes a surface active group 110 and a carbon ring 150. Other types of carbon containing components such as a straight carbon chain, or a branched carbon chain, can also be utilized to practice the invention.

The surface active group 110 attracts to a metallic oxide surface. In one embodiment, the attraction of $OH^+$ to metal oxide surfaces is used. Alternatively, other strategies for attraction to metal surfaces could be used. The carbon ring 150 is a metastable, carbon ring, such as a cyclopropane group, or a cyclobutane group. The carbon ring 150 may include three or more carbon atoms. In certain embodiments, the lubricant additive 100 further includes a spacer 130. The spacer 130 can be a carbon chain. The carbon chain can include 1-20 carbon atoms.

In certain embodiments, the carbon-based lubricant additive 100 may be cyclopropanecarboxylic acid (CPCa, FIG. 1B), cyclobutanecarboxylic acid (FIG. 1C), cyclopropanol (FIG. 1D), cyclobutanol (FIG. 1E), cyclopropylacetic acid (FIG. 1F), or a mixture thereof. In one embodiment, the lubricant additive is CPCa. CPCa is used because its simplicity and stability and it is commercially available for low costs, but many other additives are possible for this process. This includes molecules with different carbon rings such as cylcobutane and cyclopentane. The surface active $OH^+$ from alcohol can be used in place of a carboxylic acid, such as cyclobutanol, as shown in FIG. 1E.

Figure 1F:
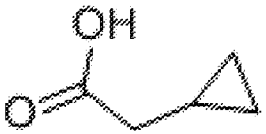
Figure 1A:
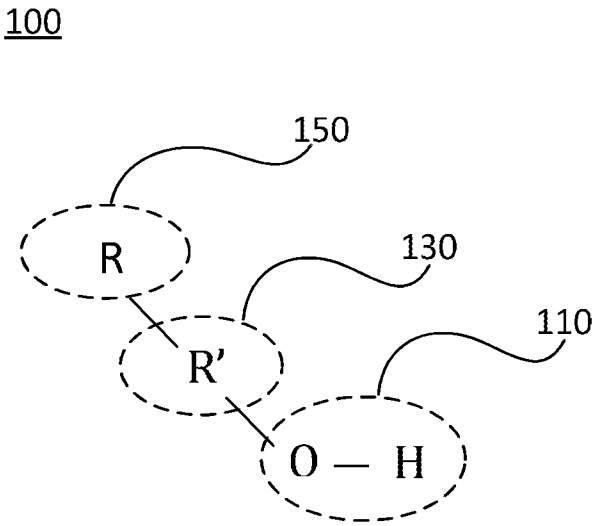
FIG. 1A shows schematically a lubricant additive molecule according to one embodiment of the invention.

Further, hydrocarbon "spacers" can be added between the surface active group and the carbon ring of the additive molecule, such as cyclopropylacetic acid, as shown in FIG. 1F. Adding one or more of these spacers could dampen some of the thermal energy coming from the contact surface temperature and therefore increase the activation energy of the carbon release.

In addition, the carbon ring can be modified to improve the additive's compatibility with the base lubricant or a formulated oil and to alter the stability of the carbon ring. In one embodiment, one can attach a side chain to one or more of the carbon atoms in the carbon ring. The side chain can alter the strain energy in the carbon ring and hence its stability.

In certain embodiments, the lubricant additive 100 can be mixed with a base lubricant, such as an oil-based lubricant, to form a lubricant composition. The lubricant composition can be used for lubrication of a machinery. In other embodiments, when the base lubricant has already been added to the machinery, the lubricant additive 100 can be added later to the base lubricant to improve lubrication efficiency and to repair wear.

In certain embodiments, the lubricant composition has about 1-10 weight percentage (wt %) of the lubricant additive molecules. In one embodiment, the lubricant composition comprises about 2.5 wt % of the lubricant additive molecules.

In certain embodiments, the lubricant additive binds to the target surface via polar (electrostatic) or chemical interactions through the surface active group.

In another aspect, the invention relates to a method of using the novel additive described above to formulate carbon coatings in situ, or during machine operation. It does so by inducing a localized chemical transformation at the site of surface contact.

Figure 2A:
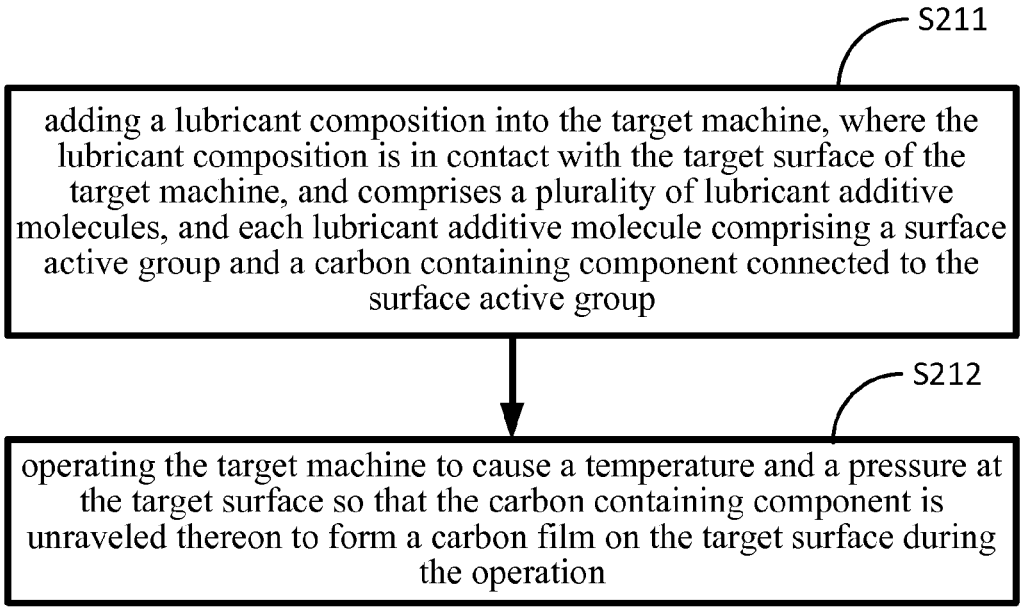
FIG. 2A shows a method of forming a carbon film in situ according to one embodiment of the invention.

Referring to FIG. 2A, the method in one embodiment includes, at step S211, adding a lubricant composition into the target machine, where the lubricant composition is in contact with the target surface of the target machine, and comprises a plurality of lubricant additive molecules, and each lubricant additive molecule comprising a surface active group and a carbon containing component connected to the surface active group; and at step S212, operating the target machine to cause a temperature and a pressure at the target surface so that the carbon containing component is unraveled thereon to form a carbon film on the target surface during the operation.

In certain embodiments, the carbon film includes a plurality of graphitic sheets, amorphous and diamond-like carbon, or a mixture thereof. In one embodiment, percentages of the graphitic sheet and the amorphous and diamond-like carbon in the carbon film depends on a temperature and a pressure at the target surface. In one embodiment, the carbon film comprises substantially the graphitic sheet.

Figure 2B:
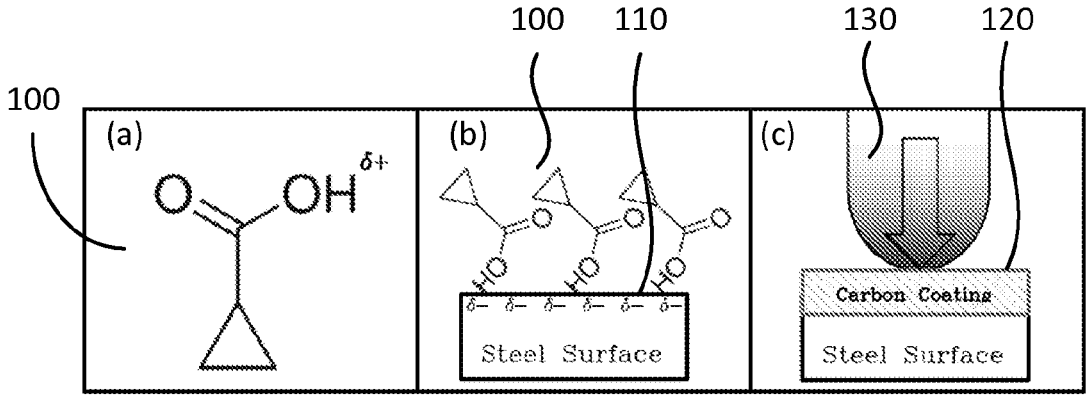
FIG. 2B shows schematically a method of forming a carbon film in situ using lubricant additive cyclopropanecarboxylic acid according to one embodiment of the invention.

FIG. 2B shows schematically an example of forming a carbon film in situ using lubricant additive cyclopropanecarboxylic acid according to one embodiment of the invention. When the carbon lubricant additive 100(*a*) is added, it is attracted to the target surface 110 via a surface active group of the lubricant additive 100(*b*). The target surface may be a contact metal surface. During the operation of a target machine have the target surface 110, the temperature and/or pressure 130 at the target surface 110 increases to its threshold due to tribology, the carbon lubricant additive 100 is decomposed to release carbon, which is deposited on the target surface 110 to form a carbon film 120 thereon (c), whereby in situ carbon coating is achieved.

In certain embodiments, the temperature at the target surface is in a range of from about room temperature to about 500° C. The room temperature may be 20° C. or 25° C. In one embodiment, the temperature at the target surface is in a range of 60° C.-300° C. In one embodiment, the temperature at the target surface is in a range of 90° C.-115° C. In one embodiment, the ambient temperature of the experiment is about 90° C. and the temperature at the target surface is higher than 90° C. due to the heat generated by friction. In one embodiment, the nominal Hertzian pressure at the target surface is in a range of 0.1 to 10 GPa. In one embodiment, the nominal Hertzian pressure at the target surface is in a range of 0.4 to 2.0 GPa. In one embodiment, by adjusting the distance between the surface active group 110 and the carbon ring 150, or the length of the spacer 130, a corresponding decomposition temperature and pressure for the carbon-based lubricant additive 100 can be obtained.

In certain embodiments, after adding the lubricant composition having the lubricant additive as described above and running the machinery such as an engine, the carbon film may be formed in a few seconds In certain embodiments, depending on the specific composition, the machinery, and environment, the carbon film may be formed in a range of less than a second minutes to 1 day. To improve tribological feature and wear, the lubricant composition or the lubricant additive may be added to the machinery one or more times, or added when it is needed, or once in a determined time.

In this exemplary embodiment shown in FIG. 2B, the carbon-based lubricant additive 100 is CPCa. CPCa is a commercially available molecule that has both a surface active COOH group and a metastable cyclopropane ring. The CPCa is added to a base lubricant to form a lubricant composition. When the lubricant composition is added to be in contact with the target surface, such as being added to an engine, the additive binds to metal surfaces of the engine, such as bearings and gears. At tribological contact surface within the machine, high temperature and pressure causes the metastable cyclopropane ring (triangle) breaking apart and releasing carbon onto the surface.

This in situ carbon coating technology allows machines to run with normal operation while carbon is released locally onto contacts surfaces. The carbon will reduce friction and wear. A small amount of this additive may provide just enough lubrication at the site of contact, eliminating the need of graphite suspensions in oil and agglomeration issues.

Without intent to limit the scope of the disclosure, exemplary examples and their related results according to the embodiments of the disclosure are given below. Note that titles or subtitles may be used in the examples for convenience of a reader, which in no way should limit the scope of the disclosure. Moreover, certain theories are proposed and disclosed herein; however, in no way they, whether they are right or wrong, should limit the scope of the disclosure so long as the disclosure is practiced according to the disclosure without regard for any particular theory or scheme of action.

Tribological Test Setup

Figure 3A:
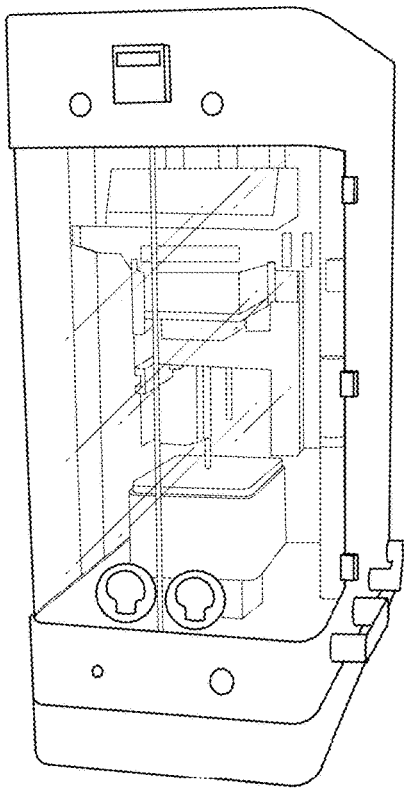
FIG. 3A shows a CERT-UMT ball-on-disk tribometer according to one embodiment of the invention.
Figure 3B:
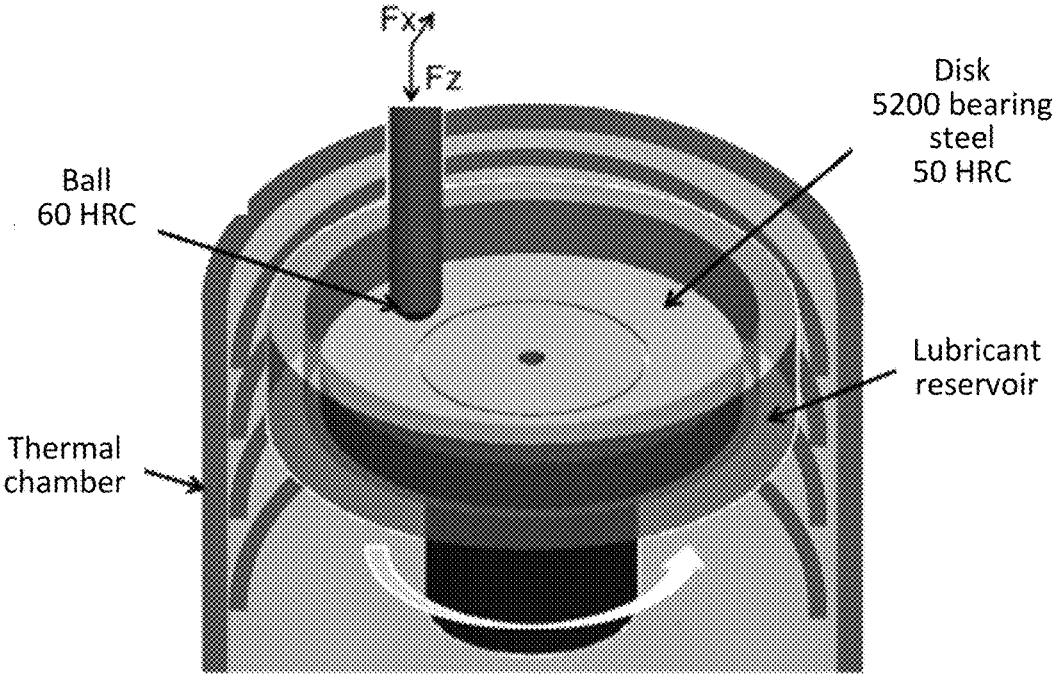
FIG. 3B shows schematically a CERT-UMT ball-on-disk tribometer setup according to one embodiment of the invention.

FIG. 3A shows a CETR-UMT ball-on-disk tribometer, and FIG. 3B shows schematically a CETR-UMT ball-on-disk tribometer setup according to one embodiment of the invention.

Tribological tests (or tribometer tests) were performed on the CETR-UMT ball-on-disk (or pin-on-disk) tribometer, as shown in FIG. 3A, to simulate sliding point contact for several test conditions. Referring to FIG. 3B, the ball-on-disk tribometer includes a ball and steel disks. The ball is made of M50 bearing steel, which has a hardness between 60 and 65 HRC. The disks are made of 52100 bearing steel, heat treated to 50 HRC, and then ground and polished to a mirror finish. In certain tests, the base oil used was ExxonMobil SpectraSyn PAO4, and the formulated oil was 5w30.

During the tribological tests, a stationary ball was brought into contact with a rotating disk, creating pure sliding contact. The temperature of the ball-on-disk tribometer was controlled, and the contact area was fully flooded with lubricating oil. Capacitive sensors on the ball holder maintained a prescribed constant vertical force, while the lateral (friction) force was measured. Each tribological test was run with two parallel trials. The ratio of the measured friction force to the applied vertical force gives the coefficient of friction over the duration of the test.

The disk and ball were both cleaned with acetone before testing. The various pin-on-disk operating conditions for boundary lubrication simulation are shown in Table 1. The conditions generally followed the ASTM Designation G99-05 [12]. The load and speed of these tests were varied slightly, and tests were done at room temperature and at 90° C., in order to simulate an engine environment.

TABLE 1

Various pin-on-disk operating conditions for boundary lubrication simulation

| | |
|---|---|
| Normal Force | 5-15 kg |
| Environment | Room temperature (RT), 90° C. |
| Relative Motion | 0.42-0.91 m/s |
| Hertzian Pressure | 0.4-1.15 GPa |
| Lubrication Regime | Boundary |
| Test Time | 30 min |
| Contact Distance | 0.53-1.6 km |
| Ball Diameter | 9.5 mm (4 mm for high temp) |

The 90° C.-ambient temperature tests were performed on a different CETR-UMT ball-on-disk tribometer with the same configuration, except for a smaller ball size. The benchmark oil used for the high temperature tests was Synfluid Poly-alpha-olefin 4 (PAO4), which is a synthetic base fluid with no additives, and has a viscosity of 4 centistokes (cSt) at room temperature [13]. Low concentrations of a lubricant additive was added to this base lubricant (or base fluid, or base oil) to test the effectiveness of the lubricant additive. Tests were also performed on fully formulated 5w30 engine oil with and without the lubricant additive, to examine any interactive benefits or issues. These tests were run under both boundary lubrication conditions, and hydrodynamic lubrication (high speed, low load) conditions.

Figure 4A:
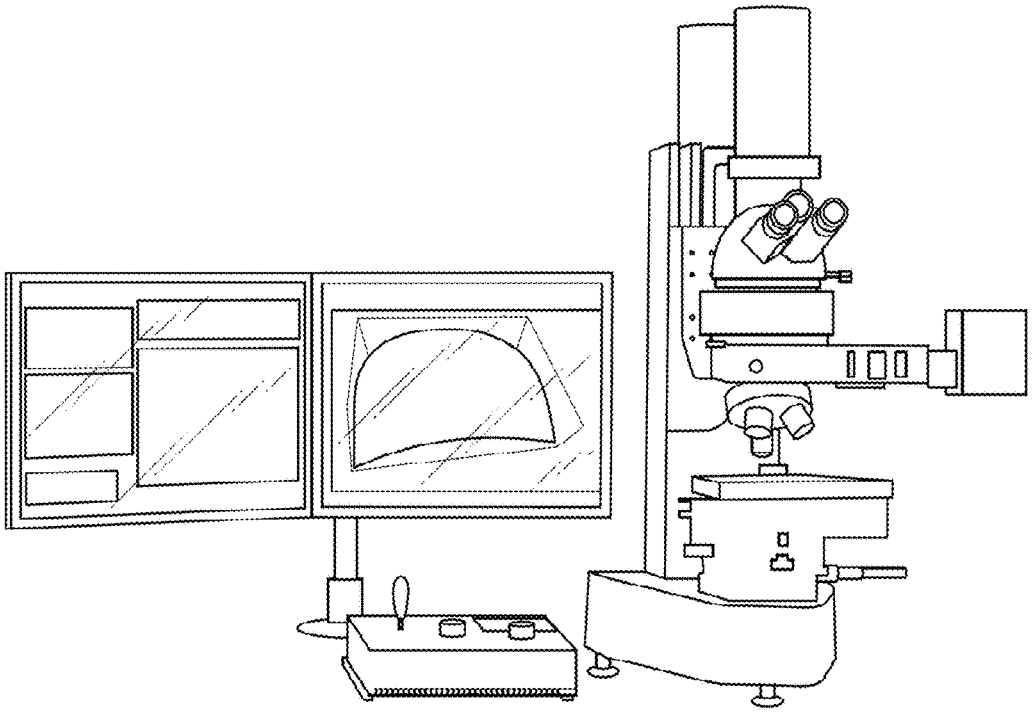
FIG. 4A shows a white light interferometry system according to one embodiment of the invention.
Figure 4B:
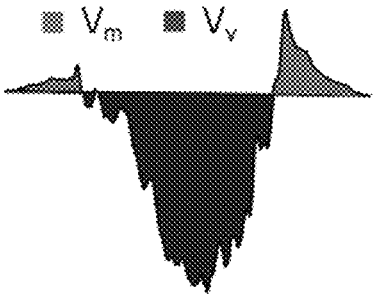
FIG. 4B shows schematically a topographical map of the surface of a wear scar determined by the white light interferometry according to one embodiment of the invention.
Figure 4C:
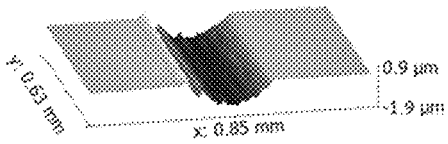
FIG. 4C shows schematically a spatially integration of the topographical map of FIG. 4B to determine the void volume and material buildup volume according to one embodiment of the invention.

The post-test tribometer disks were cleaned with acetone and then analyzed for wear damage using White Light Interferometry (WLI). Referring to FIGS. 4A-4C, WLI uses the reflection patterns of light to generate a topographical map of wear scars of the surface of the disks. Six topography scans were taken for each wear scar. The topography maps were spatially integrated, and the void volume below the average surface height was recorded. The average void volume from each topography map was reported for each trial.

Figure 5A:
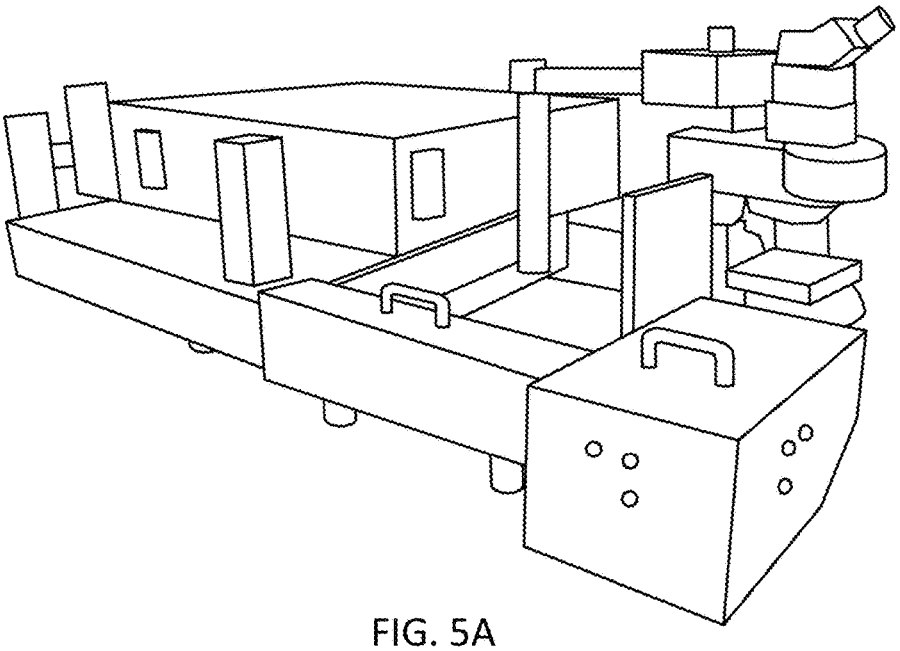
FIG. 5A shows a Confocal Raman Spectroscopy system according to one embodiment of the invention.
Figure 5B:
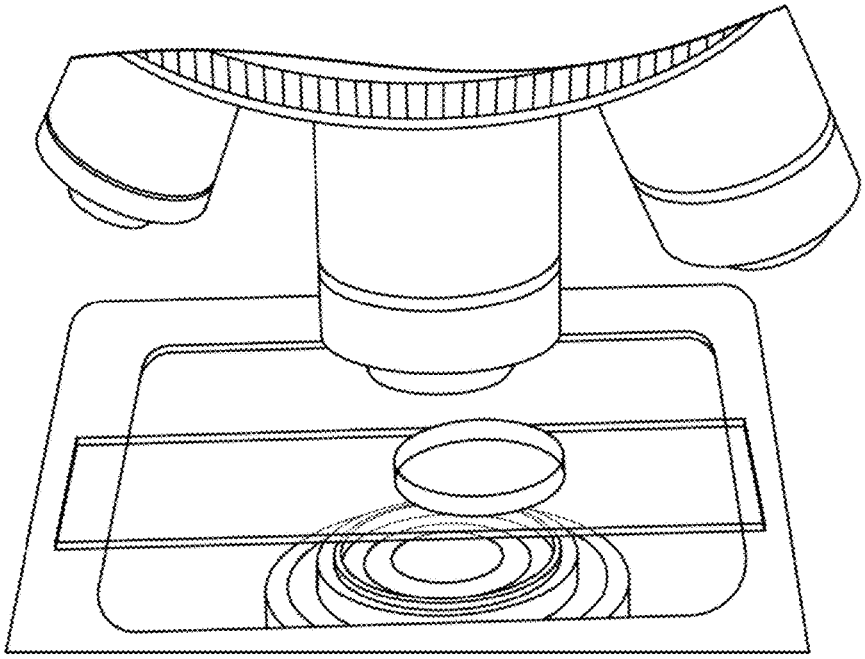
FIG. 5B shows a high powered laser is shot at sample surface according to one embodiment of the invention.
Figure 5C:
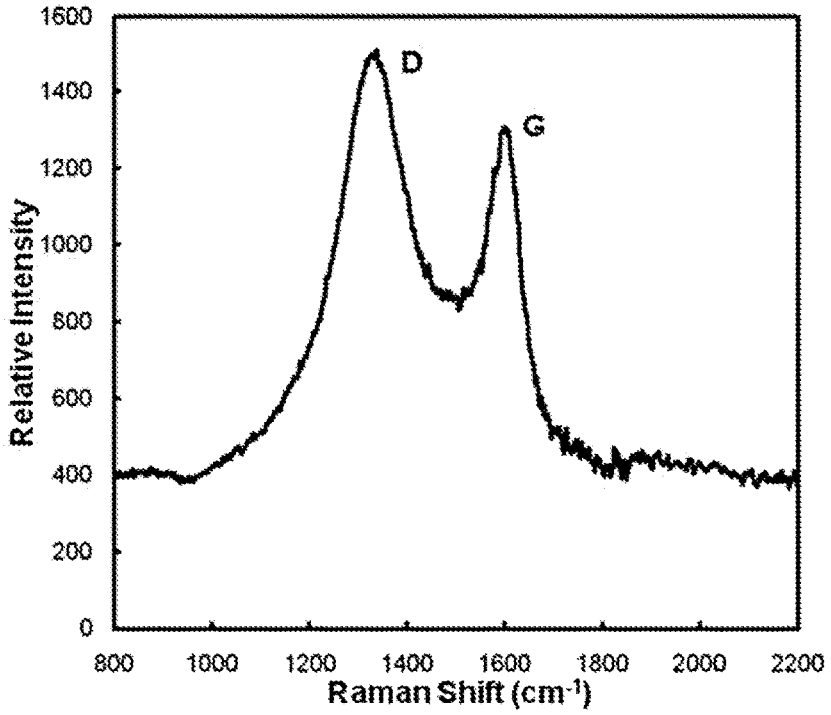
FIG. 5C shows Raman shift spectrum of carbon having D and G peaks.
Figure 5D:
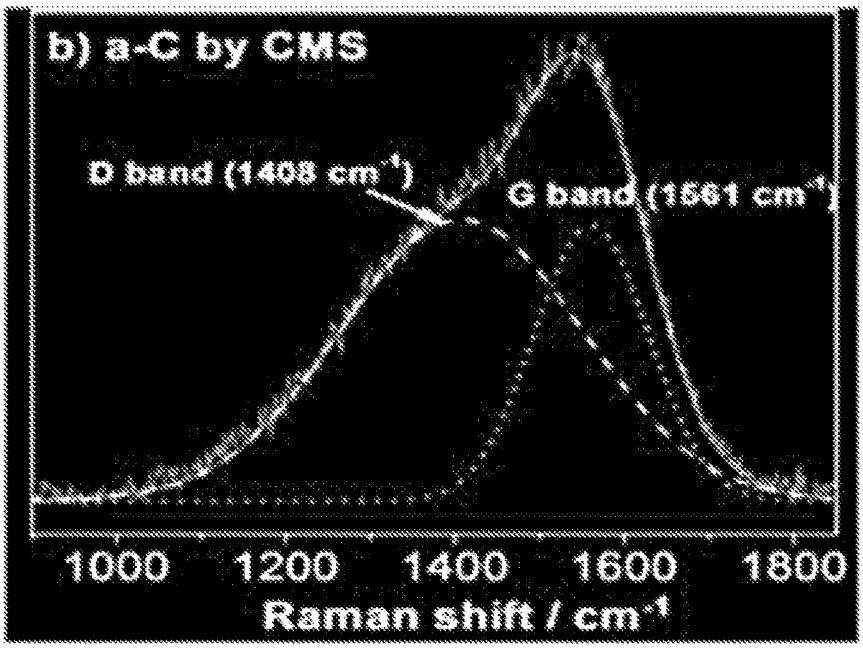
FIG. 5D shows a Raman shift spectrum of a carbon containing surface.

Referring to FIGS. 5A and 5B, further surface analysis was performed using Confocal Raman Spectroscopy. In operation, a high-powered laser is fired onto the sample surface to induce electromagnetic scattering. Referring to FIGS. 5C and 5D, certain wavelengths of this scattered energy reveal the types of elements and bonds on the sample surface. Specially, the diamond/amorphous and graphite have specific pattern associated with the presence of peaks at 1350 $cm^{-1}$ (D peak) and 1600 $cm^{-1}$ (G peak), respectively [14].

Proof-Of-Concept Test

Figure 6A:
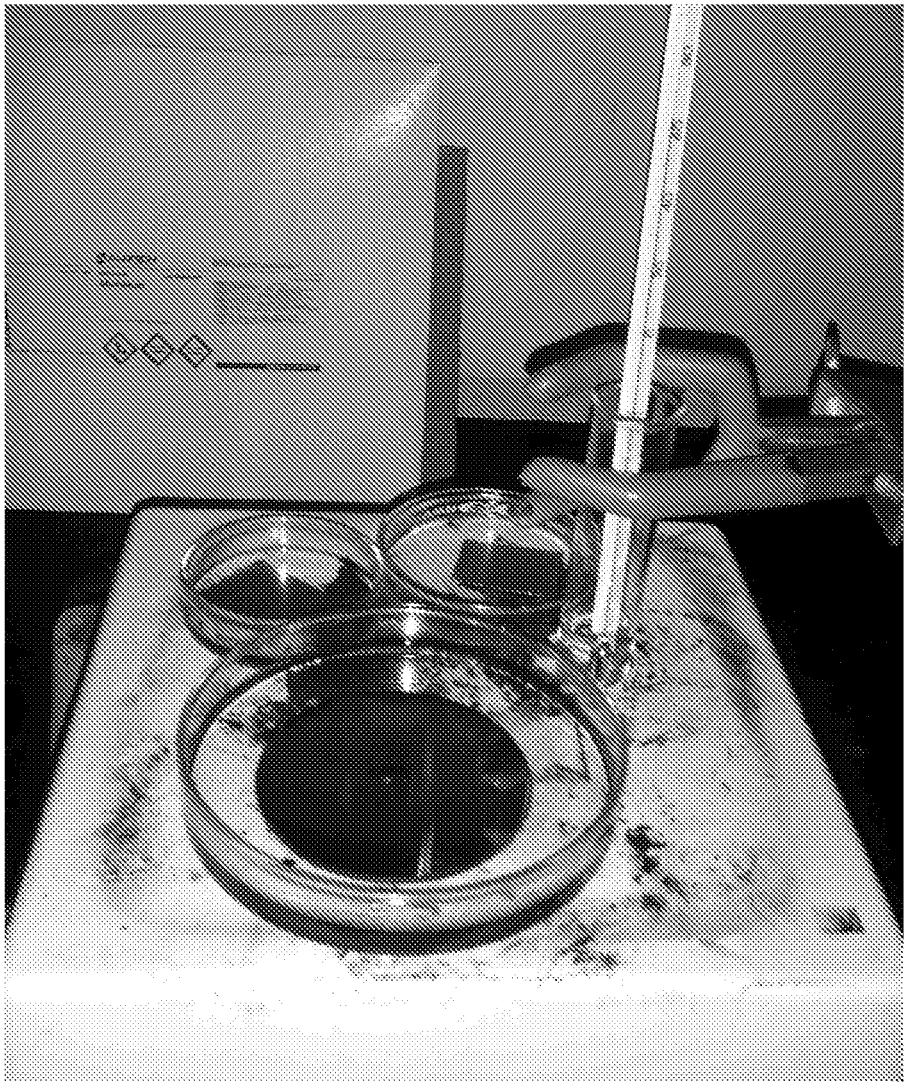
FIG. 6A shows a tribological setup according to one embodiment of the invention.
Figure 6B:
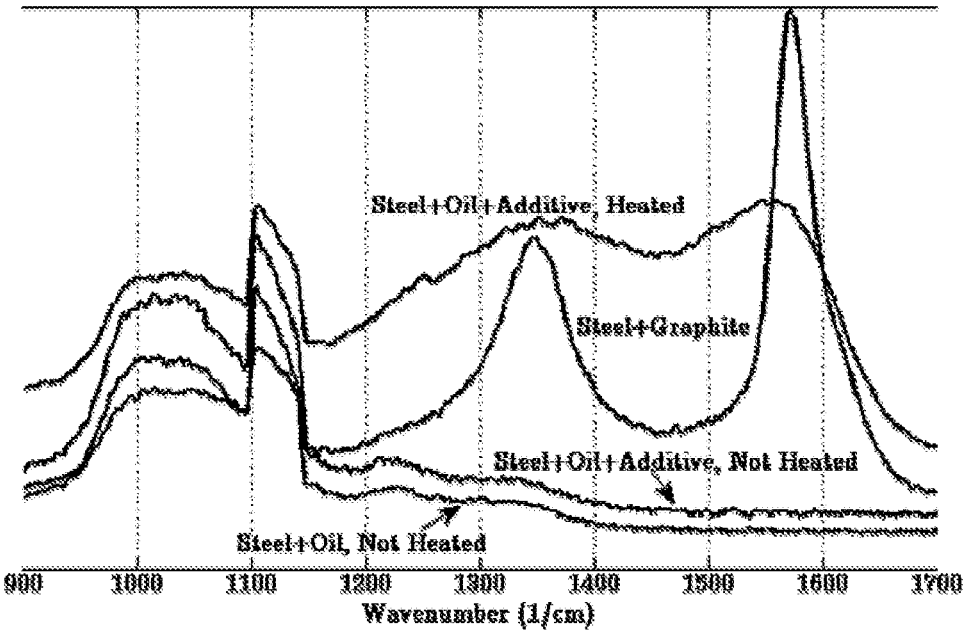
FIG. 6B shows Raman spectrum collected on the sample prepared according to FIG. 6A.
Figure 6C:
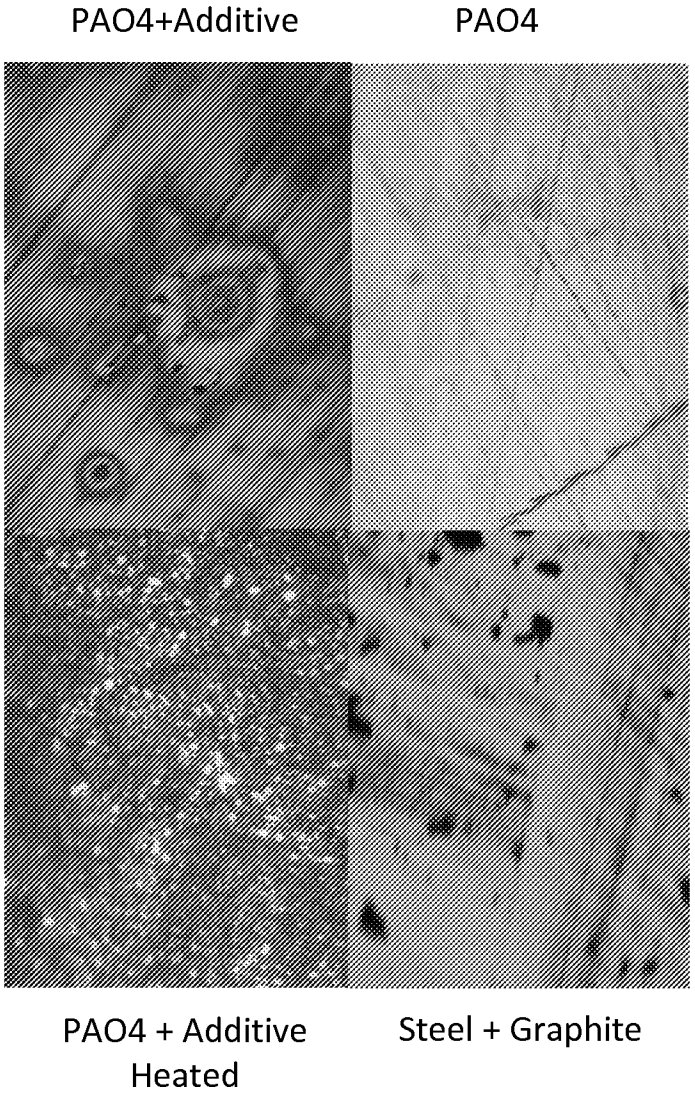
FIG. 6C shows microscopic images of surfaces of different samples prepared according to FIG. 6A.

FIG. 6A shows a tribological setup according to one embodiment of the invention, FIG. 6B shows Raman spectrum collected on the sample prepared according to FIG. 6, and FIG. 6C shows microscopic images of surfaces of different samples prepared according to FIG. 6A.

In this example, CPCa, a lubricative additive according to certain embodiments of the present invention, was tested for its carbon release by heating. Referring to FIG. 6A, polished 52100 steel coupons were submerged in a mixture of PAO4 and 5 wt % CPCa and heated on a hot plate set to 200° C. for one hour. Raman surface analysis was performed before and after heating, and the results were shown in FIG. 6B. For comparison to known carbon peaks, graphite flakes were deposited onto the steel and Raman analysis was performed.

The Raman results show that without heating, the lubricant additive have no evidence of carbon release, and match the Raman profile of oil on steel with no heating. However, after heating, characteristic carbon peaks occur for the mixture of oil with additive CPCa, which match the graphite Raman profile. The surfaces of the steel coupons are shown in FIG. 6C.

In this example, the lubricant composition (mixture of lubricant additive and base lubricant/oil according to certain embodiments of the invention) was tested in the tribometer for friction and wear results under various conditions. The lubricant composition included 5 wt % of CPCa in PAO4 as described above. The addition of CPCa to PAO4 base oil did not change the viscosity or appearance of the oil. The tribological test was performed using the parameters listed in the following Table 2.

TABLE 2

The parameters for the tribological test.

| | |
|---|---|
| Normal Force | 5-15 kg |
| Environment | RT, 90° C. |
| Relative Motion | 0.42-0.91 m/s |
| Hertzian Pressure | 0.4-1.15 GPa |
| Lubrication Regime | Boundary |
| Test Time | 30 min |
| Contact Distance | 0.53-1.6 km |

Figure 7B:
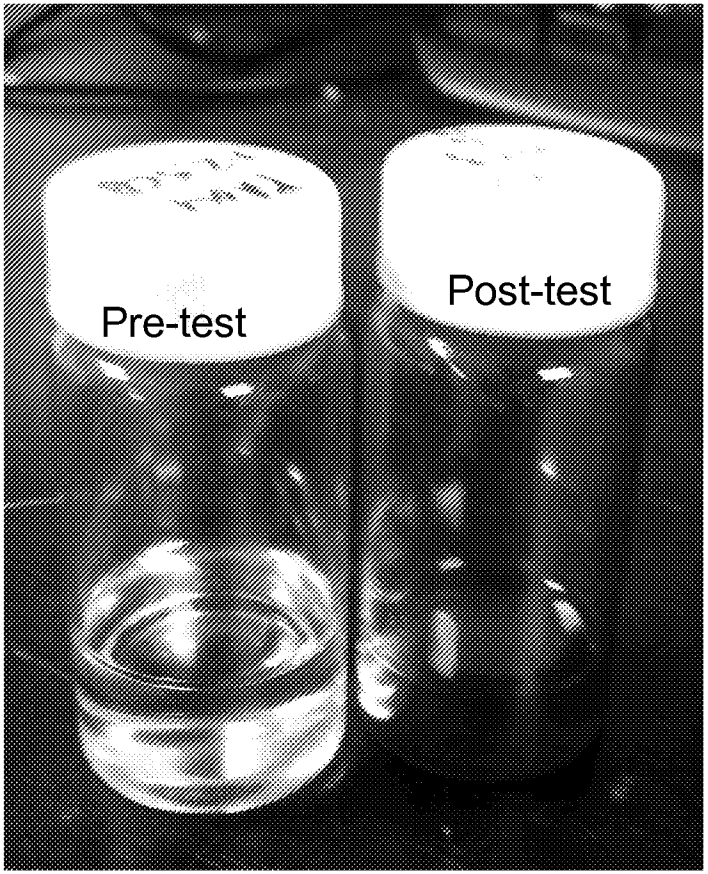
FIG. 7B shows comparison of lubricant composition before and after tribological test according to one embodiment of the invention.
Figure 7A:
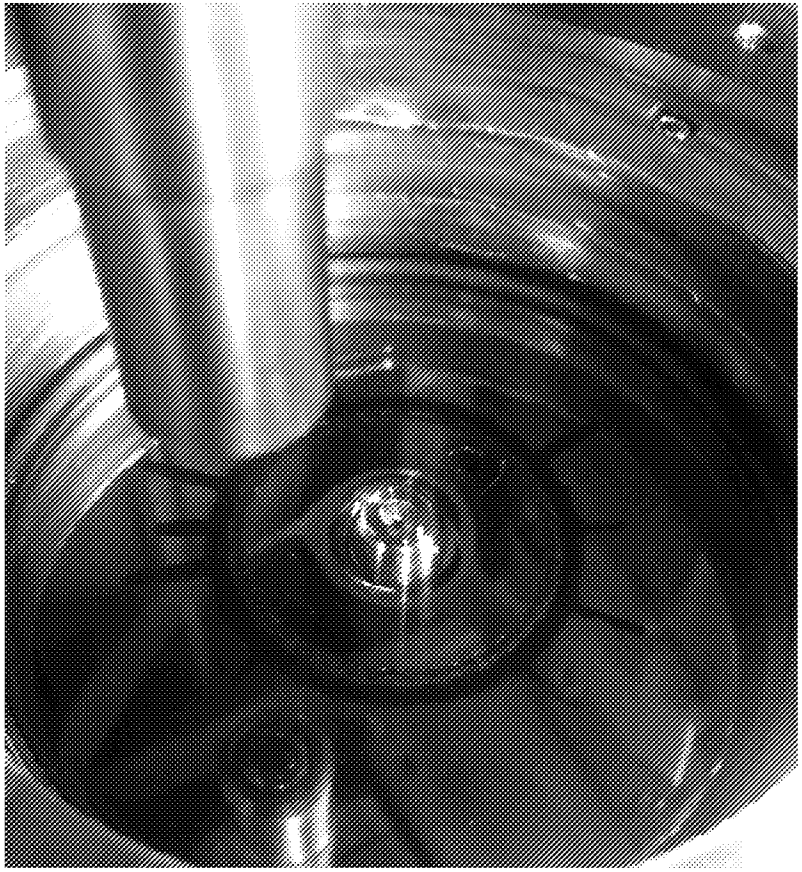
FIG. 7A shows graphitic residue on a disk after tribological test according to one embodiment of the invention.

The tribological test was performed for a few hours. After the tribological test, the post-test fluid contained carbon flakes, especially near the contact zone. An image of the post-test oil sitting on a disk is shown in FIG. 7A. Referring to FIG. 7A, dark carbon residue in oil is observed near the wear scar. FIG. 7B shows the appearance of the additive-oil mixture after tribological testing. The pre-test lubricant composition is transparent, and the post-test oil lubricant composition has a dark color.

Figure 7C:
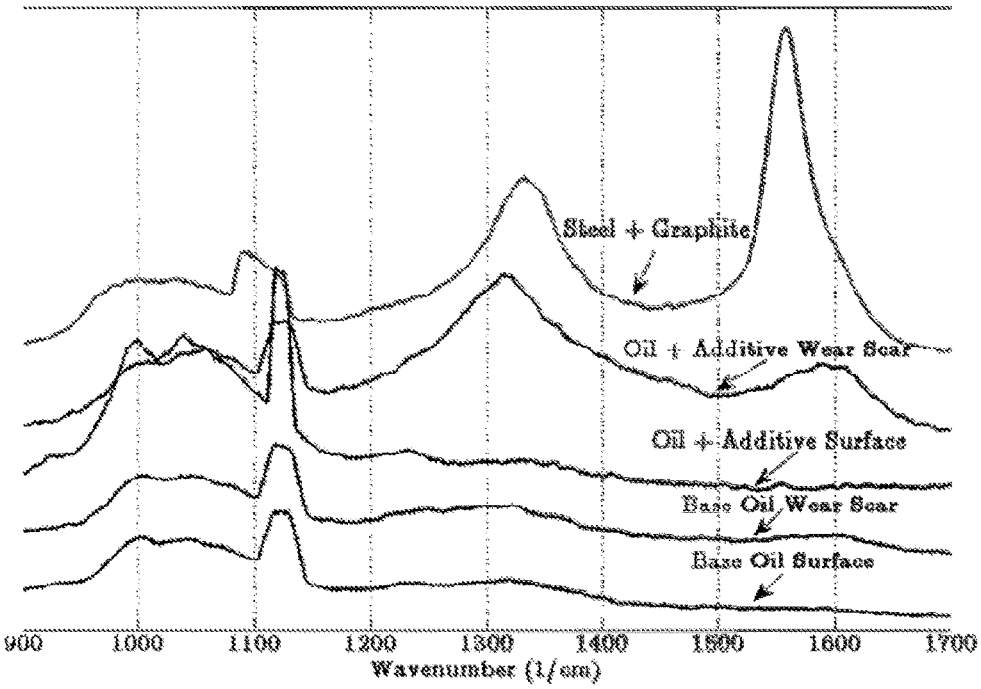
FIG. 7C shows Raman spectrum collected on different samples according to one embodiment of the invention.
Figure 7D:
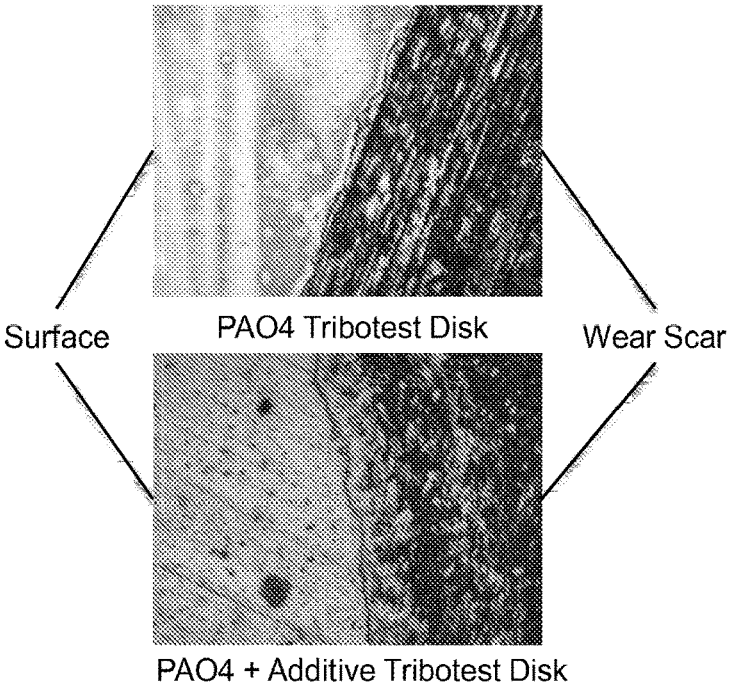
FIG. 7D shows disk surfaces around the wear scar after tribological test treated using lubricant compositions with and without lubricant additive according to one embodiment of the invention.

Further, the surfaces of the disks were tested for carbon using Raman analysis, and the results are shown in FIG. 7C. Raman scans were performed within the contact zone's wear scar and outside on the disk's polished surface. The graphite-on-steel sample is also shown for comparison. For the tribological test using only PAO4, no carbon peaks are present. The PAO4 +CPCa sample also does not show carbon peaks outside of the contact zone. However, within the wear scar, carbon peaks are present for the PAO4+CPCa lubricant composition, due to released carbon from the lubricant additive under tribological heat and pressure. FIG. 7D shows the polished surface and the surface of the wear scar in the contact zone.

Optimal Lubricant Additive Concentration

In this example, the optimal lubricant additive concentration for friction and wear reduction was tested. Boundary lubrication tests for pure PAO4 and PAO4 containing 1, 2.5, and 5 wt % of CPCa were performed. The tribological test was performed using the parameters listed in the following Table 3.

TABLE 3

The parameters for the tribological test.

| | |
|---|---|
| Normal Force | 15 kg |
| Environment | RT |
| Relative Motion | 0.91 m/s |
| Hertzian Pressure | 1.15 GPa |

TABLE 3-continued

The parameters for the tribological test.

| | |
|---|---|
| Lubrication Regime | Boundary |
| Test Time | 30 min |
| Contact Distance | 1.6 km |

Figure 8A:
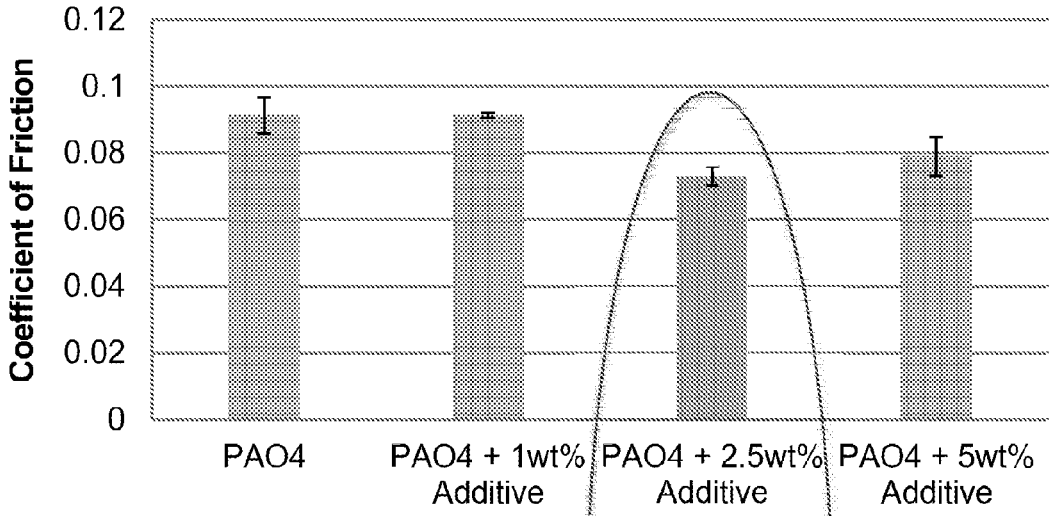
FIGS. 8A and 8B show tribological test results using different concentrations of a lubricant additive according to one embodiment of the invention, where
Figure 8B:
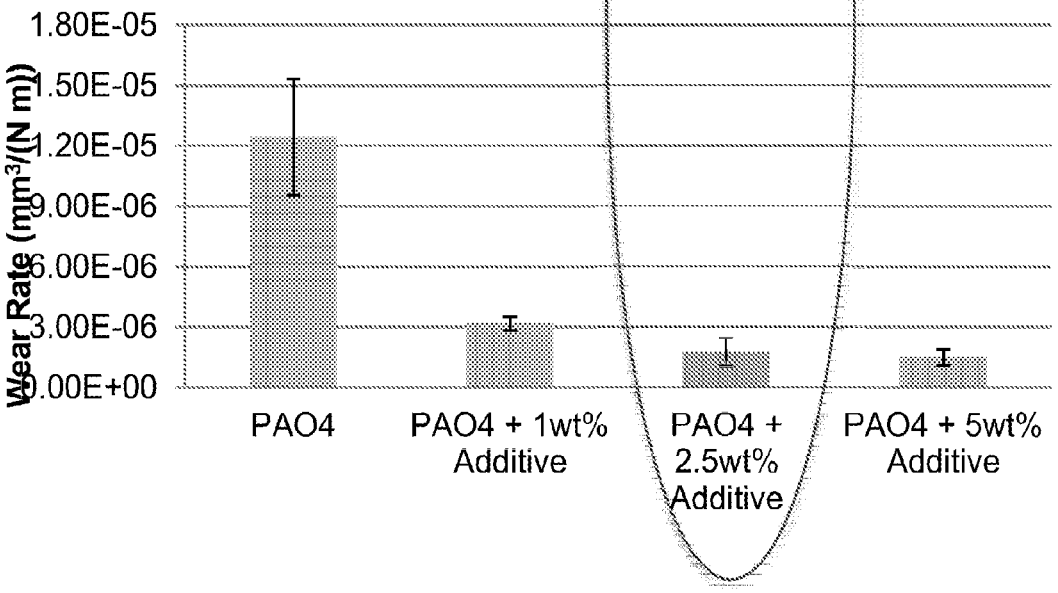

According to the friction results as shown in FIG. 8A and FIG. 8B, 2.5 wt % of CPCa provides optimal friction reduction. Wear was also significantly reduced in the 2.5 wt % trial. Generally, a minimal amount of a lubricant additive should be used, so it does not interfere with other additives or the behavior of the base oil. High concentrations of the additive (20 wt %) were also tested, but showed very poor results.

Friction Versus Time

Figure 9:
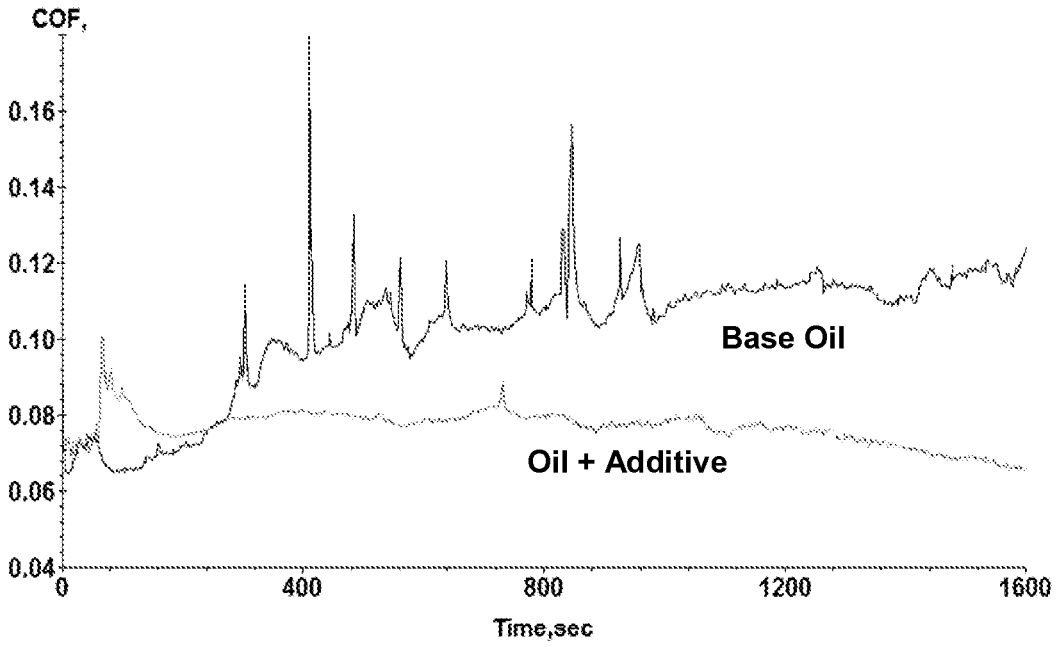
FIG. 9 is time plots of friction using lubricant compositions with and without lubricant additive according to one embodiment of the invention.

In this example, a friction versus time test is performed on a tribometer. FIG. 9 is time plots of friction using lubricant compositions with and without lubricant additive.

Referring to FIG. 9, the oil+additive plot shows an initial increase in friction, correlated to asperity contact, but as carbon is released from the additive, friction reduces. For the base oil, friction spikes corresponding to asperity contact are present. The carbon released from the additive mitigates these friction spikes due to asperity contact and thus shows a more smooth curve. In certain embodiments, the lubricant with the additive shows about 20% reduction in friction in boundary lubrication over that without the additive.

Varied Load and Speed

Figure 10A:
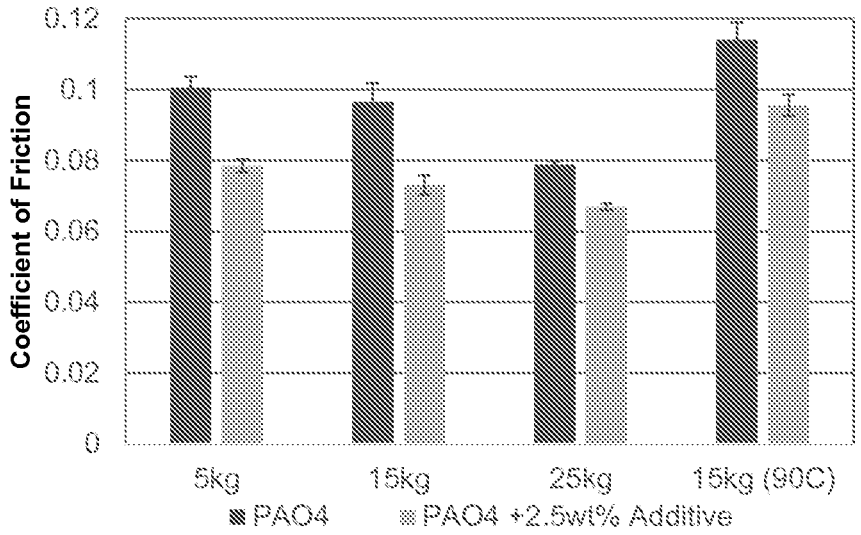
FIGS. 10A and 10B show tribological test results using lubricant compositions with and without the lubricant additive, and under different loads, speeds and temperature according to one embodiment of the invention, where
Figure 10B:
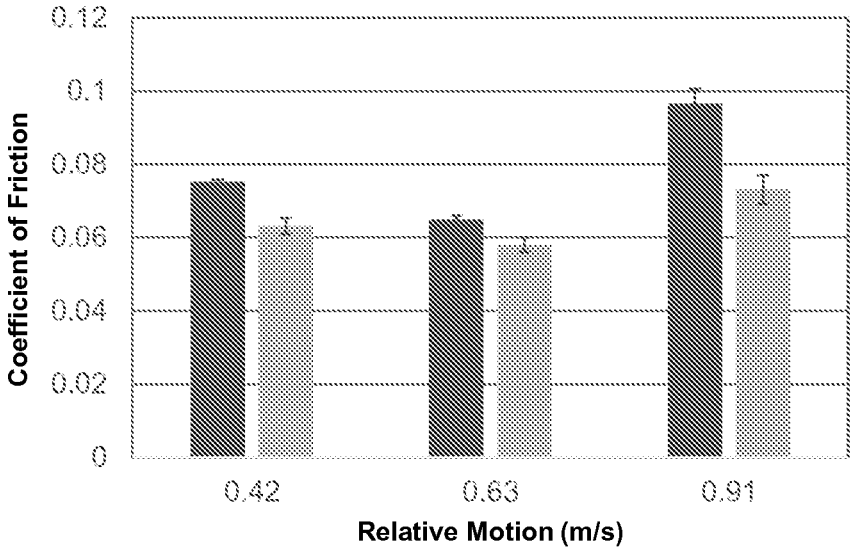

Tribological test were performed with the estimated optimal concentration of 2.5 wt % lubricant additive. FIGS. 10A and 10B show tribological test results using lubricant compositions with and without the lubricant additive, and under different loads, speeds and temperature. FIGS. 10A and 10B show the time-average friction results for a range of tribometer loads and speeds, and a test at increased temperature. For the plot with varying load, the relative motion was 0.91 m/s, and for the plot with varying speed, the load was 15 kg. All of these tests were in the boundary lubrication regime, with an average Hertzian pressure of 1 GPa, and a film thickness predicted to be less than 1 micron.

Referring to FIGS. 10A and 10B, friction is shown to be reduced by as much as 20% for several-cases. The lubricant additive seems to be less effective at reducing friction at certain speeds.

Wear Volume

FIGS. 11A-11D show tribological wear test results using lubricant compositions with and without the lubricant additive, and under different loads, speeds and temperature.

Figure 11A:
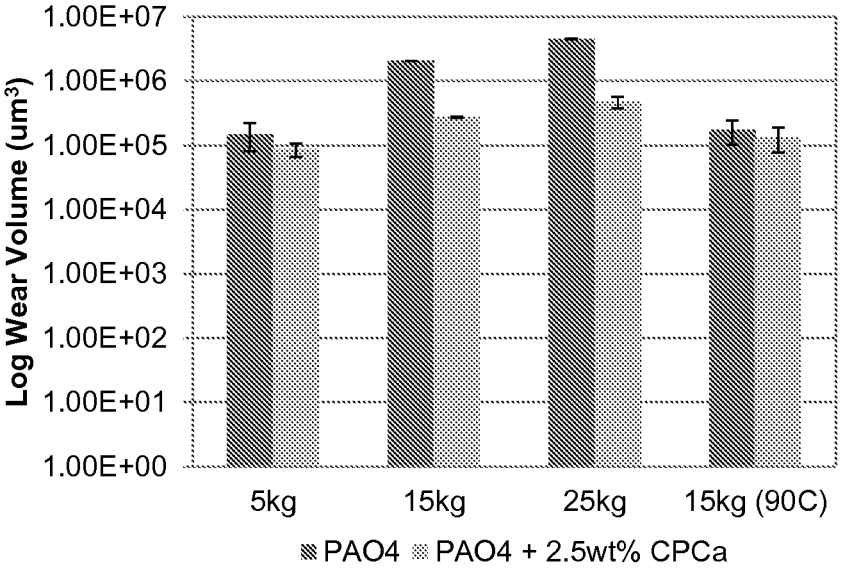
FIGS. 11A-11D show tribological wear test results using lubricant compositions with and without the lubricant additive, and under different loads, speeds and temperature according to one embodiment of the invention, where
Figure 11B:
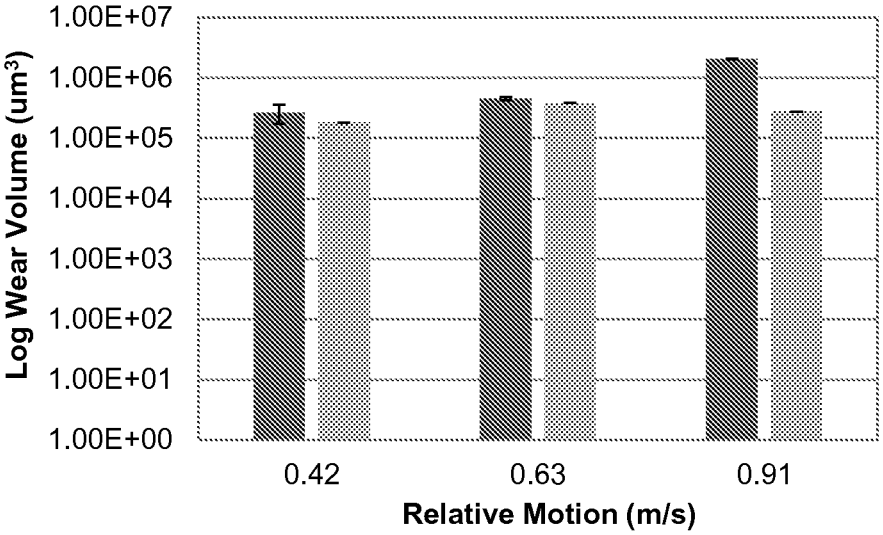
Figure 11C:
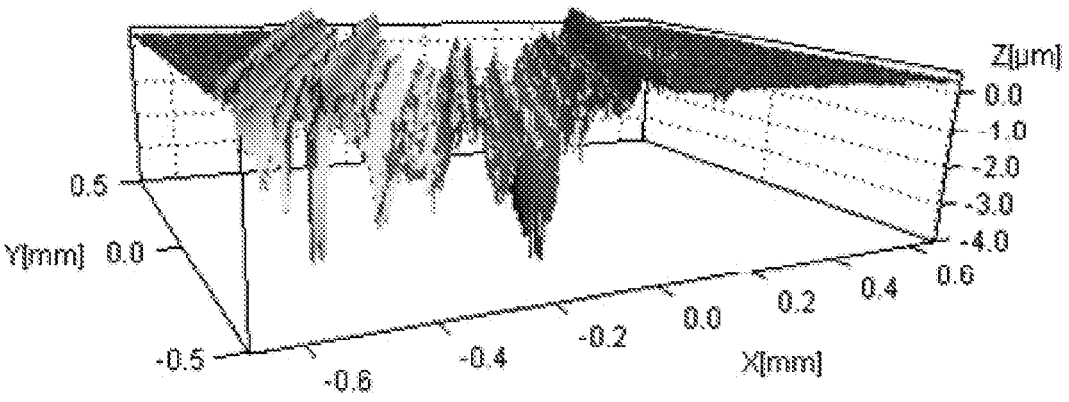
Figure 11D:
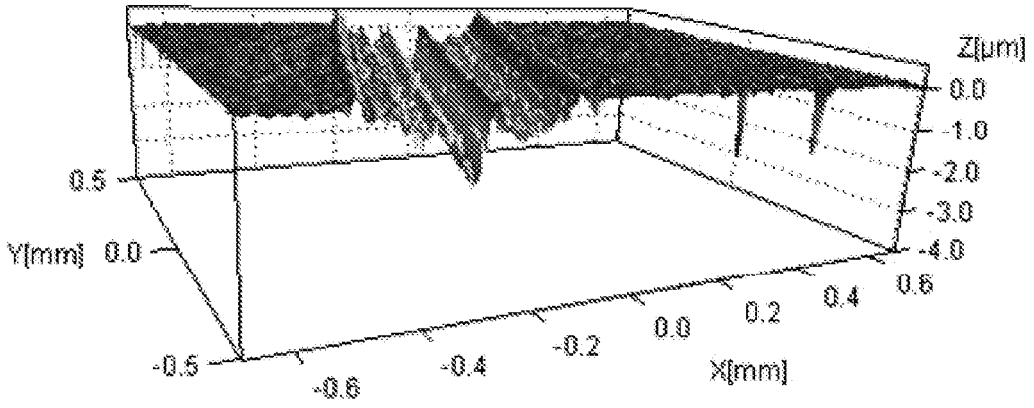

FIGS. 11A and 11B show the wear volume results for the same set of tests as described in the section of VARIED LOAD AND SPEED, and FIGS. 11C and 11D shows surface observed by WLI. The wear results correspond to friction results for most of the tests. In many cases, there was an order of magnitude reduction in wear with the addition of CPCa. The wear reduction at high temperature was lower because there was less initial wear from the pure PAO4 test. Carbon is only evident in the wear scar, where tribological heat/pressure activated the carbon formation from the additive. Base oil did not show evidence of carbon formation in the wear scar.

2-Stage Test

With significant friction and wear reduction demonstrated, this example aimed to examine if the carbon deposited by the CPCa remains effective even after the additive is no longer present in the lubricant.

A 2-stage tribometer test was performed: in stage 1, boundary lubrication tests were performed on disk A with PAO4, and on disk B with PAO4+2.5 wt % CPCa. Then, without removing the disks from the tribometer, the fluids were cleaned from the system. After that, in stage 2, the tests were repeated using pure PAO4 on both disks. As with all tribometer tests in this example, the experiment was repeated at least twice. The tribological test was performed using the parameters listed in the following Table 4.

TABLE 4

The parameters for the tribological test.

| | |
|---|---|
| Normal Force | 15 kg |
| Environment | 90° C. |
| Relative Motion | 0.91 m/s |
| Hertzian Pressure | 1.15 GPa |
| Lubrication Regime | Boundary |
| Test Time | 60 min |
| Contact Distance | 3.2 km |

Figure 12A:
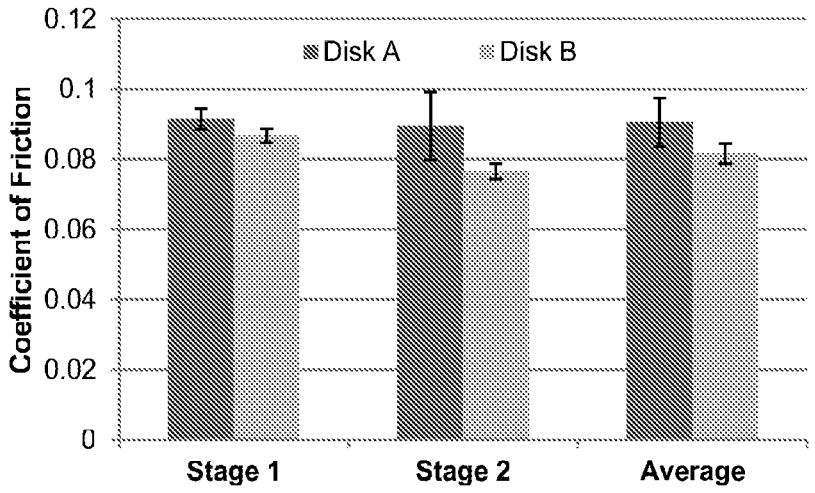
FIGS. 12A and 12B show tribological two-stage test results of two disks treated with lubricant compositions with and without the lubricant additive, where
Figure 12B:
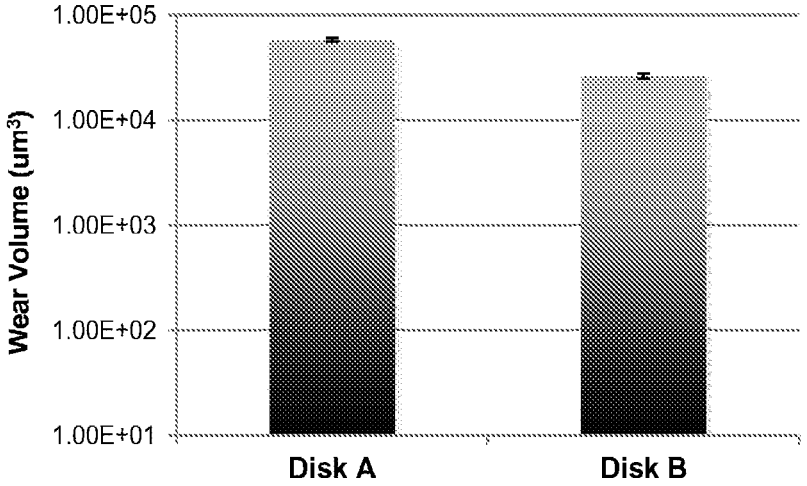

FIGS. 12A and 12B show tribological two-stage test results of two disks treated with lubricant compositions with and without the lubricant additive, where FIG. 12A shows a plot of coefficient of Friction at stage 1, stage 2, and the average, FIG. 12B shows a plot of wear volume of the two disks at stage 2. Referring to FIGS. 12A and 12B, friction is reduced in Disk B, for both stage 1 and stage 2. A coating of carbon generated in stage 1 provides lasting improvement in friction, even after the additive is removed. FIGS. 12A and 12B also shows wear reduction in disk B, as expected.

Adding Lubricant Additive to a Formulated Oil

Figure 13A:
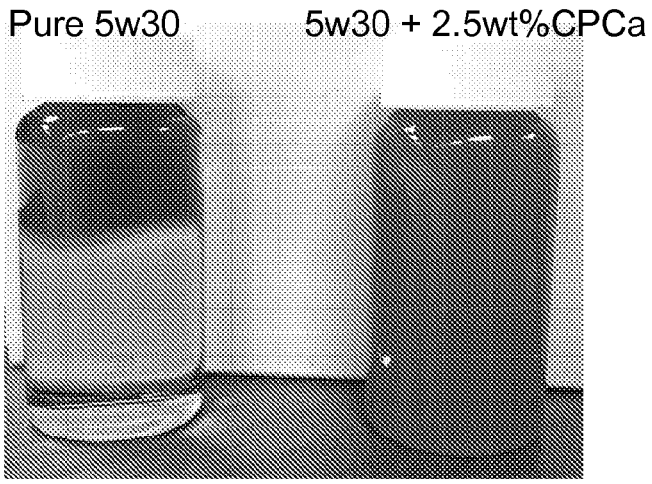
FIGS. 13A-13C show tribological test results using formulated 5w30 engine oil with and without adding the lubricant additive, where

In this example, a fully formulated 5w30 engine oil mixed with CPCa was tested. The formulated oil is made of a base fluid similar to PAO4, but it also contains its own assortment of anti-friction, anti-wear, viscosity modifying, and detergent additives. It is important to examine how the CPCa interacts with these additives, and to see the additive can be effective with formulated oil. In one specific example, one or more of the components in the formulated oil made the CPCa insoluble. As shown in FIG. 13A, the oil became cloudy and more viscous as CPCa was added to it. In other embodiments, the lubricant additive is compatible with the solubility of the formulated oil. In one embodiment, another additive is added to improve the solubility of CPCa in the formulated oil.

Two tribometer tests were performed using pure 5w30 and a mixture of 5w30 with 2.5 wt% CPCa. A boundary condition test was performed with similar conditions to previous tests, at 15 kg load and 0.91 m/s relative motion. Another test simulated hydrodynamic lubrication (HL), with a load of 1 kg and relative motion of 5 m/s. The HL test was performed because the insolubility of the additive was expected to change the viscosity of the fluid and increase friction.

Figure 13B:
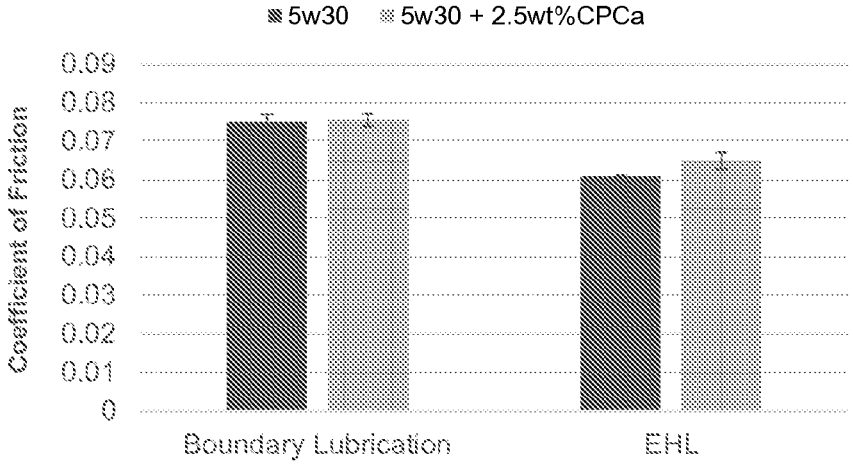
Figure 13C:
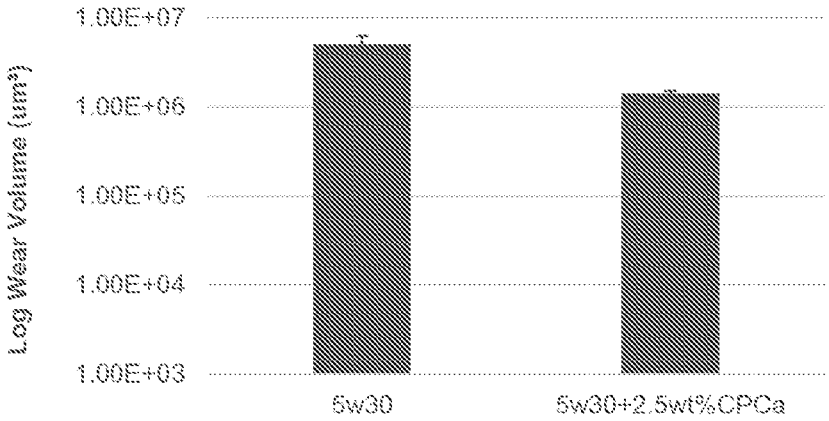
Figure 14A:
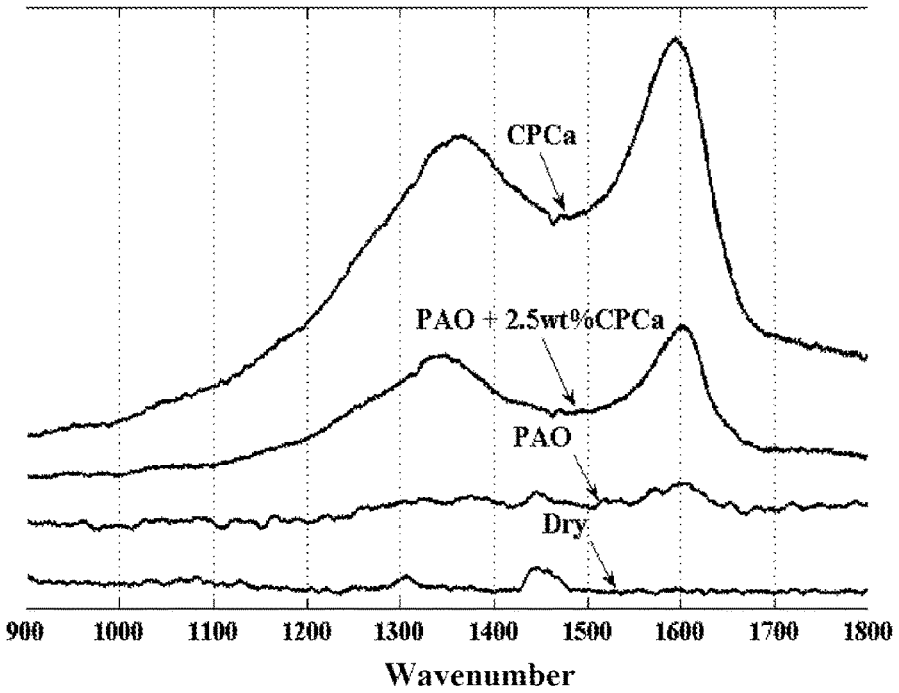
FIGS. 14A and 14B show the EAμR test result using lubricant compositions with and without adding the lubricant additive, where
Figure 14B:
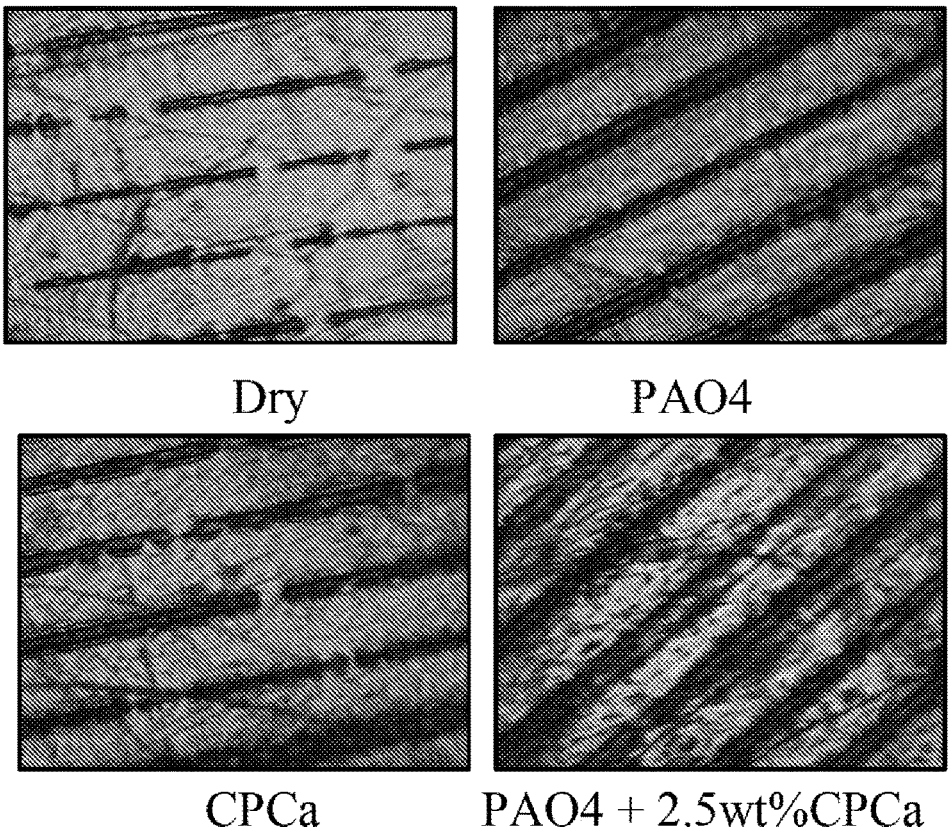

As shown in FIG. 13B, friction was statistically the same with and without the additive in the boundary lubrication regime. Friction increased slightly with the additive in the HL regime. However, as shown in FIG. 13C, the additive remains effective in reducing wear, and carbon residue is still seen on the post-test disk surface. Wear analysis was only performed on the boundary lubrication samples, because the HL tests did not produce significant wear.

Friction and Wear Performance

These experiments were performed to further assess the friction and wear performance of the additive technology in typical vehicle engine environments (about 1 GPa, 25-175° C.), and to further examine the carbon materials present after tribological testing, both in the lubricating fluid, and on the tribological surface using Raman spectroscopy.

The tribological experiments were performed using a CETR UMT-3 tribometer in the pin-on-disk configuration, with the conditions listed in Table 5.

TABLE 5

The parameters for the tribological test.

| | |
|---|---|
| Fully flooded boundary lubrication | |
| Group III base oil, with and without 2.5 wt % of Cyclopropanecarboxylic acid | |
| Load | 45N |
| Ambient Temperature | 25° C., 100° C., 175° C. |
| Distance | 900 m |
| Linear speed | 500 mm/s |
| Test Time52100 bearing steel disk60 min | |
| M50 bearing tool steel ball | |

Friction and wear performances were measured similarly to the other experiments disclosed above. The wear data is presented using Archard's wear coefficient, which normalizes the wear by material properties, load, and distance traveled.

$$\text{Wear coefficient } (K) = \frac{\text{Wear volume } (\text{m}^3) \times \text{Surface hardness } (Pa)}{\text{Normal load } (N) \times \text{Sliding distance } (\text{m})}$$

Figure 15A:
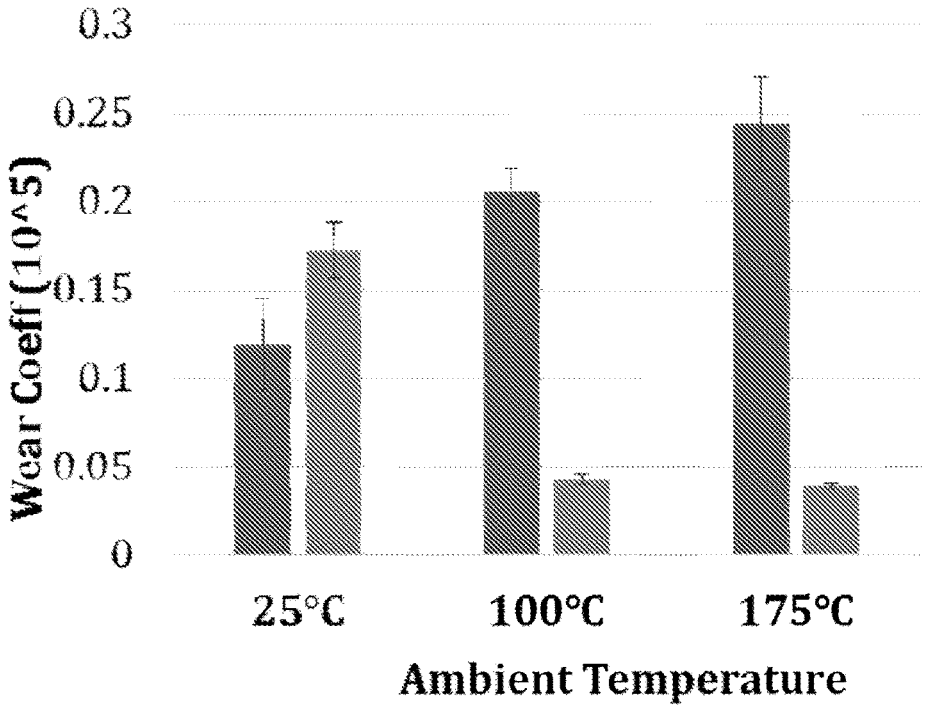
FIGS. 15A and 15B show respectively the friction and wear test results using the lubricant composition having the lubricant additive according to embodiments of the present invention.

As shown in FIG. 15A, wear reduction was not effective at room temperature for this load (45N), but there was extreme wear reduction of around 80% at 100° C. and 175° C. ambient temperature. Wear reduction corresponds to the presence of carbon in post-test Raman analysis on the fluids and on surfaces (shown in FIGS. 16-18).

Figure 15B:
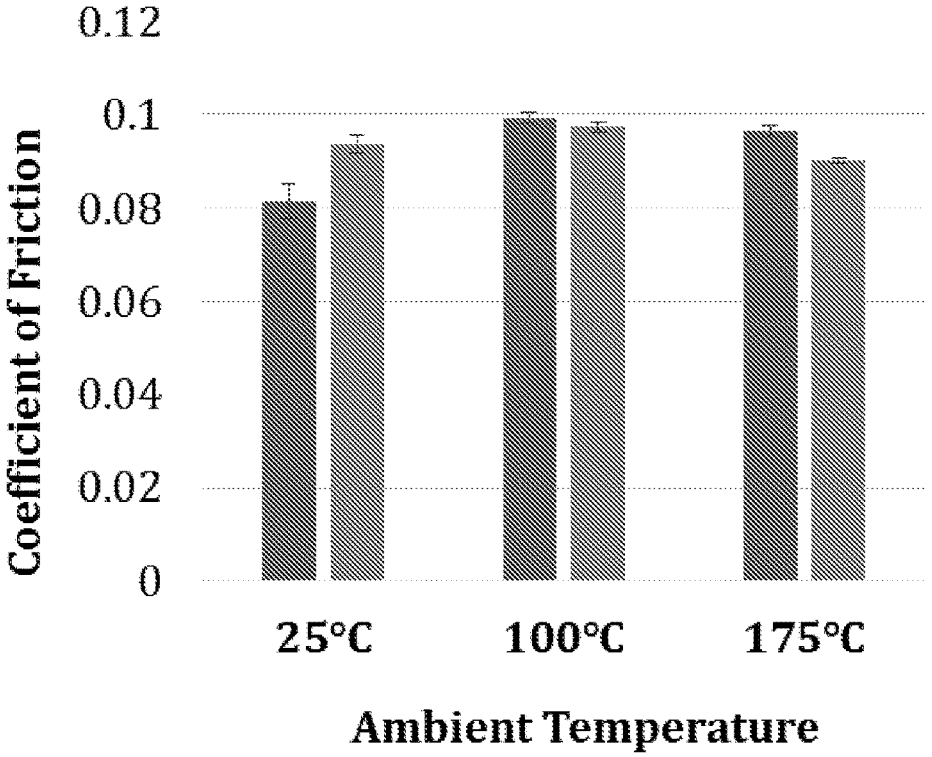

As shown in FIG. 15B, friction was not improved at room temperature, but friction is reduced by up to 8% at higher temperatures. For engine applications, this is a substantial improvement.

Figure 16:
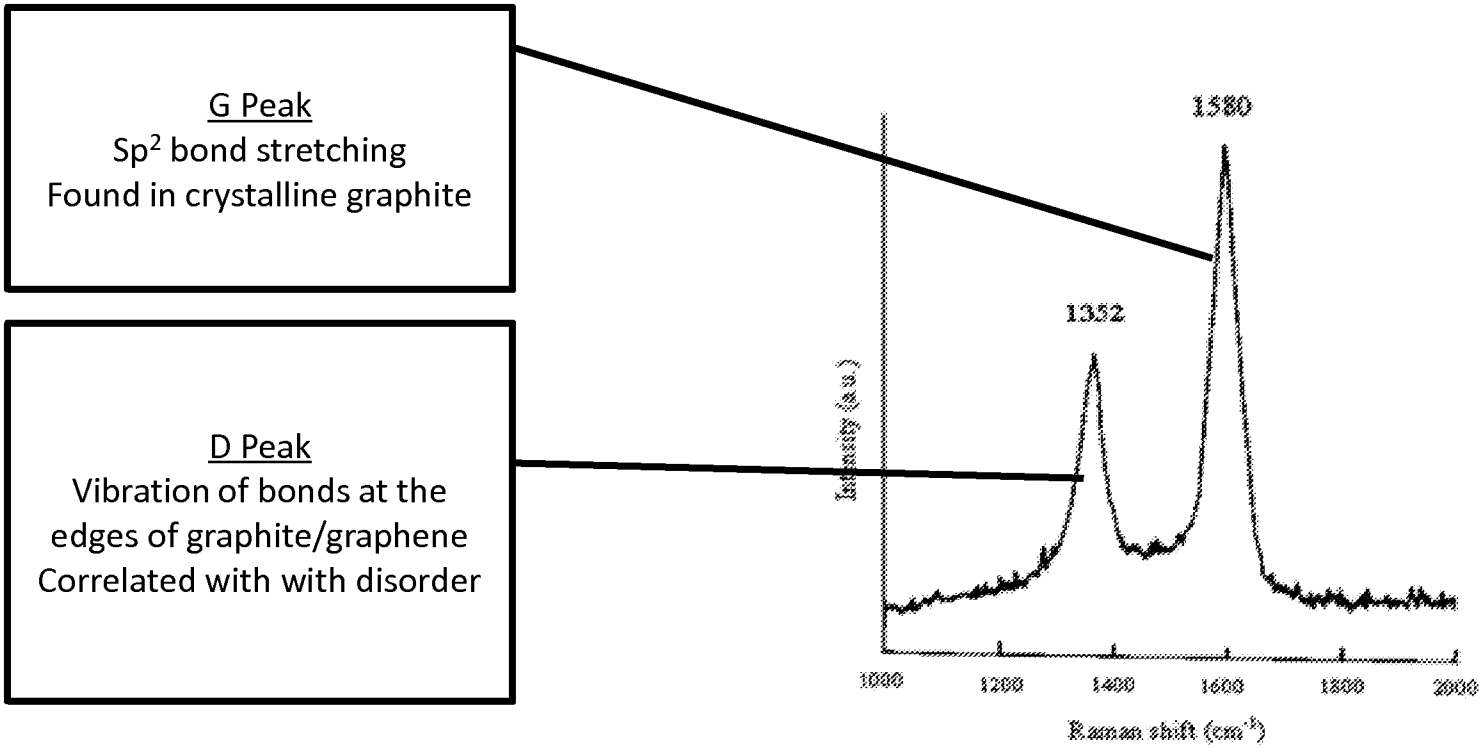
FIG. 16 shows the Raman spectrum of the carbon materials presented after tribological testing according to one embodiment of the present invention.

Raman data was collected using a Confocal Raman Spectrometer. Carbon materials appear through Raman spectrum in two peaks, as shown in FIG. 16. The ratio of the intensities of the G peak over the D peak corresponds with more graphitic crystallinity. So if the first peak is higher, the carbon is closer to amorphous carbon or DLC, and if the second peak is higher, the carbon is more graphitic.

Figure 17:
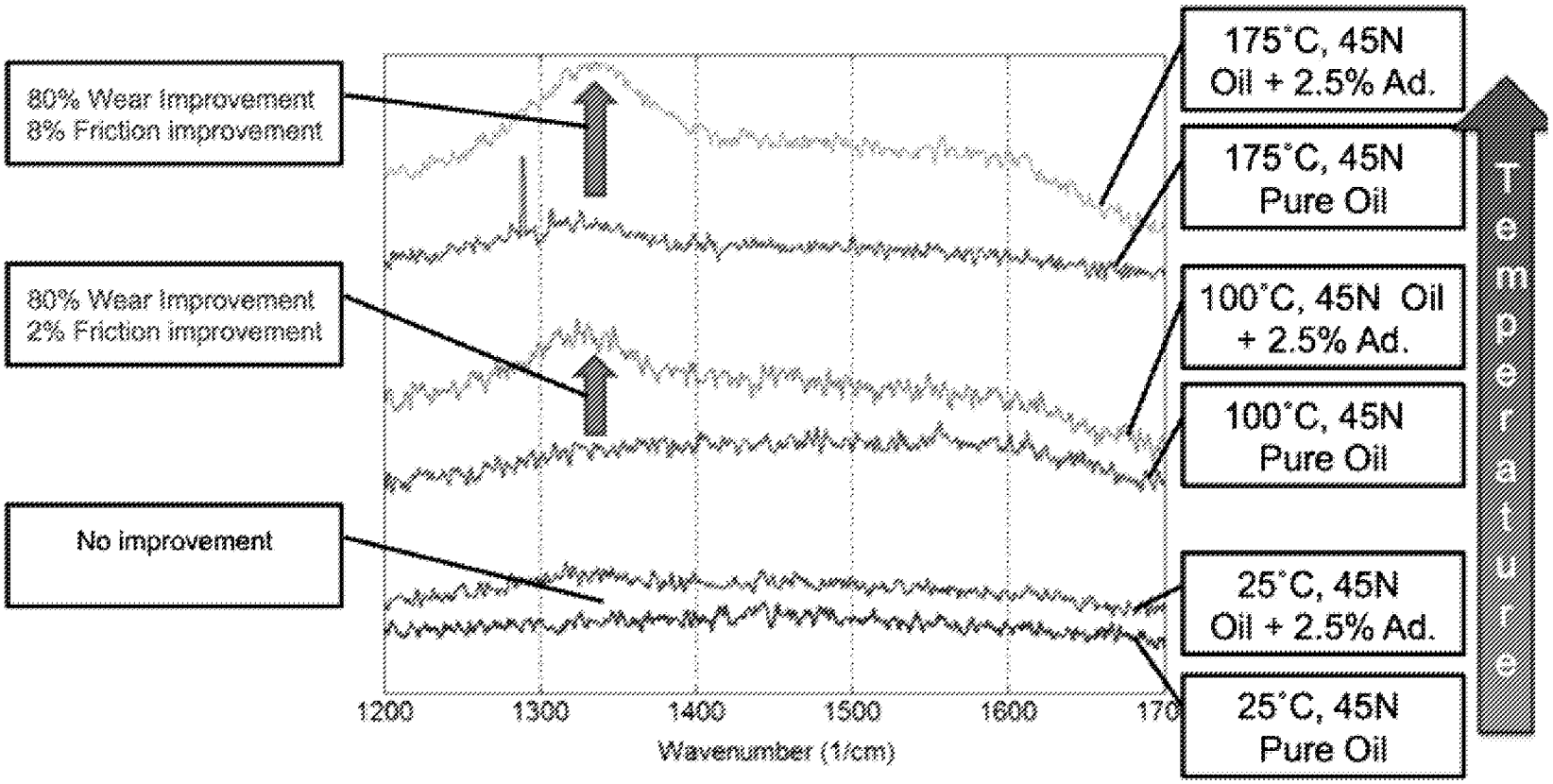
FIGS. 17 and 18 show the Raman spectra of a post-test tribometer disks according to embodiments of the present invention.
Figure 18:
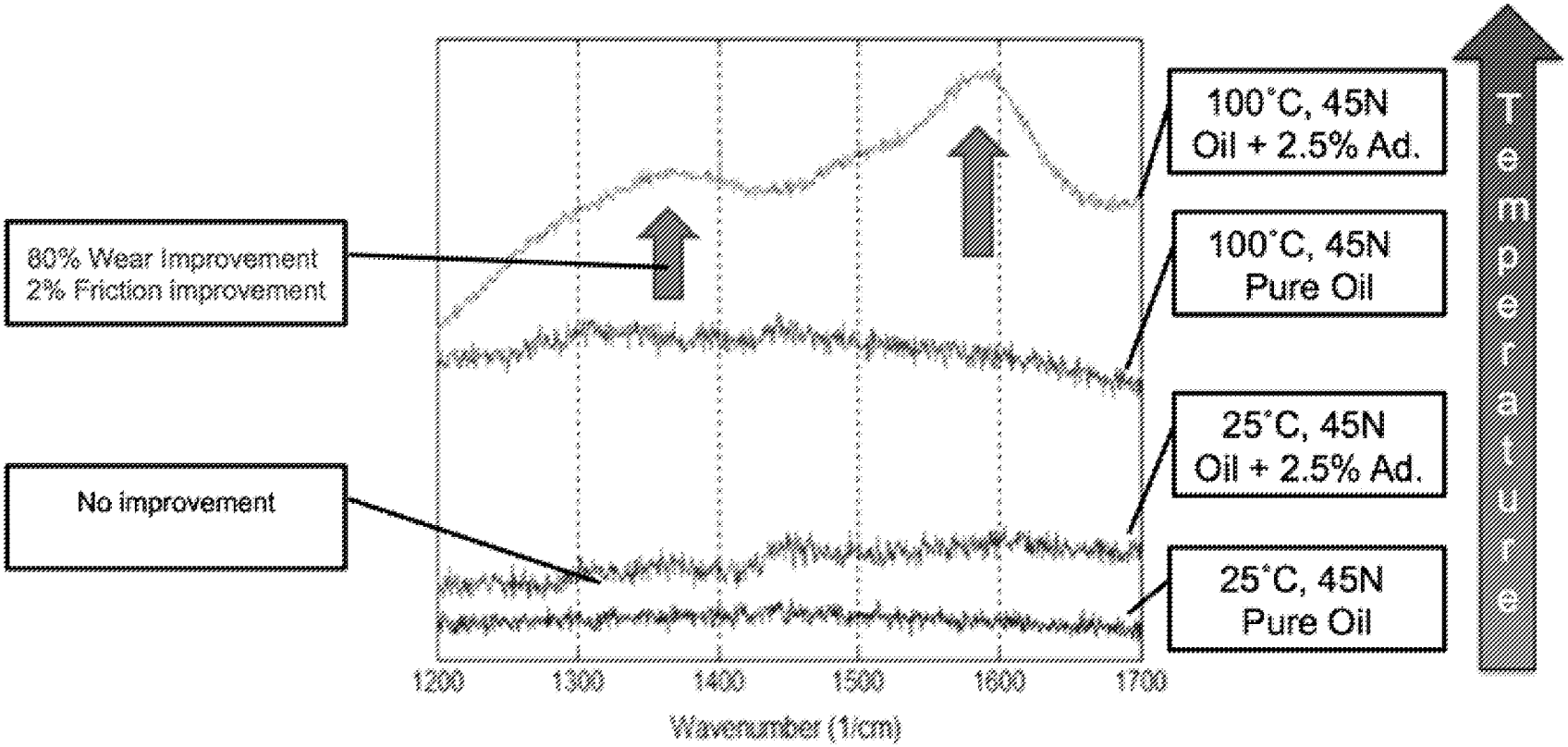

FIG. 17 shows the Raman spetra for which the post-test tribometer disks were cleaned using hexanes and acetone and wiped off with a kim-wipe. The Raman laser was focused into the center of the wear scar. At room temperature, no carbon is present on the surface for any sample, but at 100° C. and 175° C., amorphous carbon is present on additive-containing samples. The 1350 $cm^{-1}$ peak is larger, indicating more amorphous carbon. The amorphous carbon is being generated in situ, during normal tribological conditions, and it behaves like a DLC coating and contributes to wear protection FIG. 18 shows the Raman spetra for which the post-test lubricant fluid was collected onto a microscope slide, and the Raman laser was focused on the solid particles suspended in the fluid, if any were present. At room temperature, the additive has no effect. At 100° C., carbon appears in the sample containing the additive. The second peak is larger, indicating more graphitic carbon. The graphitic carbon is either generated directly from the additive, or it is part of a transfer film being generated from the amorphous carbon tribofilm. Most of the fluid on the 175° C. samples dissolved away during tribology testing because of the high temperature, so no Raman analysis could be performed.

In sum, the present invention discloses, among other things, a lubricant composition including the lubricant additive molecules and a method for in situ forming of a carbon film using the lubricant composition. Each lubricant additive molecule includes a surface active group attractable to a target surface, and a carbon containing component connected to the surface active group, for providing a carbon source to form a carbon film on the target surface. The method includes adding the lubricant composition into a target machine such that the lubricant composition is in contact with a target surface of the target machine, and operating the target machine to cause a temperature and a pressure at the target surface so that the carbon containing component is unraveled thereon to form a carbon film on the target surface during the operation.

Certain embodiments of the invention, among other things, have the following advantages.

(1) In situ carbon coating additive releases lubricious carbon when activated by heat and/or pressure.

(2) Carbon is supplied locally to the point of contact, without the need of pre-processing or suspension of graphite in oil.

(3) Effective in reducing boundary lubrication friction and wear, compared to pure base oil: about 20% friction reduction, and one order of magnitude reduction in wear.

(4) Lasting effectiveness of carbon coatings is present even after additive is removed from oil.

(5) Can be applied during operation of machinery.

(6) Wear improvement with formulated oil.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

LIST OF REFERENCES:

[1]. K. Holmberg, P. Andersson, and A. Erdemir, Global energy consumption due to friction in passenger cars, Tribology International 47 (2012) 221-234.

[2]. Dake, "A Review of DOE ECUT Tribology Surveys," J. Tribol., vol. 108, no. (4), pp. 497-501, 1986.

[3]. R. Savage, "Graphite Lubrication," Journal of Applied Physics, vol. 19, no. 1, pp. 1-10, 1948.

[4]. H. Y. Hisakado, "Lubrication mechanism of solid lubricants in oils," Journal of Lubrication Technology, vol. 105, p. 245, 1983.

[5]. A. Kovalchenko, "Friction and Wear Performance of Low-Friction Carbon Coatings Under Oil Lubrication," Energy Technology Div., Argonne National Laboratory, Argonne, Ill., 2001.

[6]. A. Grill, "Diamond-like carbon: state of the art," Diamond and related materials, vol. 8, no. 2, pp. 428-434, 1999.

[7]. A. Grill, "Diamond-like carbon: stage of the art," Diamond and related materials, vol. 8, no. 2, pp. 428-434, 1999.

[8]. de Barros' Bouchet, "Boundary lubrication mechanisms of carbon coatings by MoDTC and ZDDP additives," Tribology International, vol. 38, no. 3, pp. 257-264, 2005.

[9]. Morina, "Understanding the composition and low friction tribofilm formation/removal in boundary lubrication," Tribology International, vol. 40, no. 10, pp. 1696-1704, 2007.

[10]. Singer, "Role of Third Bodies in Friction Behavior of Diamond-like Nanocomposite Coatings Studied by In Situ Tribometry," Tribology Transactions, vol. 45, no. 3, pp. 363-371, 2002.

[11]. Erdemir, "Tribochemically driven diamond-like carbon boundary films from base lubricating oils," in STLE Annual Meeting, Detroit, 2013.

[12]. ASTM, "Standard test method for wear testing with a pin-on-disk apparatus," in ASTM Book of Standards, 2010, pp. G99-05.

[13]. Chevron Phillips, "Synfluid PAO 4 cSt," Chevron Phillips, The Woodlands, Tex., 2011.

[14]. H. Halidou, "Novel carbon nano structures of caterpillar-like fibers and interwoven spheres with excellent surface super-hydrophobicity produced by chemical vapor deposition," Journal of Materials Chemistry, vol. 18, no. 11, pp. 1245-1252, 2008.

What is claimed is:

1. A method for in situ forming a carbon film on a target surface of a target machine, comprising:

adding a lubricant composition into the target machine, wherein the lubricant composition is in contact with the target surface of the target machine, and comprises a plurality of lubricant additive molecules, and each lubricant additive molecule comprising a surface active group and a carbon containing component connected to the surface active group, wherein the surface active group comprises a carboxyl group, a siloxyl group, an amine group, or a mixture thereof, the carbon containing component comprises a carbon ring; and operating the target machine to cause a temperature and a pressure at the target surface so that the carbon containing component is unraveled thereon to form a carbon film on the target surface during the operation, wherein the lubricant composition comprises cyclopropanecarboxylic acid, cyclobutanecarboxylic acid, cyclopropylacetic acid, cyclopropanol, or a mixture thereof.

2. The method of claim 1, wherein the plurality of lubricant additive molecules binds to the target surface via polar (electrostatic) or chemical interactions through the surface active group of each lubricant additive molecule.

3. The method of claim 2, wherein the surface active group of each lubricant additive molecule has positive charges, and the target surface has negative charges, and vice versa, such that the surface active group is attractable to the target surface.

4. The method of claim 1, wherein the carbon containing component of each lubricant additive molecule further comprises a straight carbon chain, a branched carbon chain, or a mixture thereof.

5. The method of claim 1, wherein the temperature is in a range of 25° C.-500° C., and the pressure is in a range of 0.4-2 Gpa.

6. The method of claim 1, wherein the carbon film comprises a plurality of graphitic sheets, amorphous and diamond-like carbon, hydrocarbon, or a mixture thereof.

7. The method of claim 6, wherein percentages of the graphitic sheets and the amorphous and diamond-like carbon in the carbon film depends on the temperature and the pressure at the target surface.

8. The method of claim 7, wherein the carbon film comprises substantially the graphitic sheet.

9. The method of claim 1, wherein the carbon film is formed in a period of time in a range of from less than one second to one day.

10. The method of claim 1, wherein the target machine is an engine.

* * * * *